US010684567B2

(12) United States Patent
Sugawara et al.

(10) Patent No.: US 10,684,567 B2
(45) Date of Patent: Jun. 16, 2020

(54) TONER FOR DEVELOPING ELECTROSTATIC IMAGE, ELECTROSTATIC-IMAGE DEVELOPER, AND TONER CARTRIDGE

(71) Applicant: FUJI XEROX CO., LTD., Tokyo (JP)

(72) Inventors: Atsushi Sugawara, Kanagawa (JP); Kana Yoshida, Kanagawa (JP); Tsuyoshi Murakami, Kanagawa (JP); Masaki Iwase, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/669,477

(22) Filed: Aug. 4, 2017

(65) Prior Publication Data

US 2018/0143550 A1 May 24, 2018

(30) Foreign Application Priority Data

Nov. 21, 2016 (JP) ..... 2016-225867

(51) Int. Cl.

| | |
|---|---|
| ***G03G 9/087*** | (2006.01) |
| ***G03G 9/08*** | (2006.01) |
| ***G03G 9/09*** | (2006.01) |
| ***G03G 15/08*** | (2006.01) |

(52) U.S. Cl.

CPC ..... *G03G 9/08755* (2013.01); *G03G 9/0819* (2013.01); *G03G 9/0821* (2013.01); *G03G 9/0827* (2013.01); *G03G 9/08782* (2013.01); *G03G 9/08795* (2013.01); *G03G 9/08797* (2013.01); *G03G 9/0902* (2013.01); *G03G 9/0926* (2013.01); *G03G 15/0865* (2013.01)

(58) Field of Classification Search

CPC ..... G03G 9/08782

See application file for complete search history.

(56) References Cited

U.S. PATENT DOCUMENTS

| | | | | |
|---|---|---|---|---|
| 8,859,175 | B2 | 10/2014 | Sugawara et al. | |
| 9,012,113 | B2 | 4/2015 | Suzuki et al. | |
| 2011/0255899 | A1* | 10/2011 | Iwamoto | G03G 9/0804 399/111 |
| 2013/0078565 | A1* | 3/2013 | Yoshida | G03G 9/0804 430/108.2 |
| 2016/0216623 | A1* | 7/2016 | Sakai | G03G 9/0819 |

FOREIGN PATENT DOCUMENTS

| | | | |
|---|---|---|---|
| JP | 2006-243714 | A | 9/2006 |
| JP | 2010-039171 | A | 2/2010 |
| JP | 2010-164909 | A | 7/2010 |
| JP | 2014-016598 | A | 1/2014 |

* cited by examiner

*Primary Examiner* — Peter L Vajda

(74) *Attorney, Agent, or Firm* — Oliff PLC

(57) ABSTRACT

A toner for developing an electrostatic image includes toner particles that each include a binder resin and a release agent. The ratio B/A of a half-width B of an exothermic peak Tc resulting from the release agent which is determined in a first cooling step by differential scanning calorimetry to a half-width A of an endothermic peak Tm resulting from the release agent which is determined in a first heating step prior to the first cooling step by differential scanning calorimetry is 1.5 or more and 4 or less.

20 Claims, 2 Drawing Sheets

TONER FOR DEVELOPING ELECTROSTATIC IMAGE, ELECTROSTATIC-IMAGE DEVELOPER, AND TONER CARTRIDGE

CROSS-REFERENCE TO RELATED APPLICATIONS

This application is based on and claims priority under 35 USC 119 from Japanese Patent Application No. 2016-225867 filed Nov. 21, 2016.

BACKGROUND

(i) Technical Field

The present invention relates to a toner for developing an electrostatic image, an electrostatic-image developer, and a toner cartridge.

(ii) Related Art

With the advance of equipment and the development of communication networks in the information society, an electrophotographic process has been widely used in copying machines, network printers for offices, printers for personal computers, printers for on-demand printing, and the like. Accordingly, both monochrome printers and color printers are increasingly required to achieve high image quality, a high printing speed, high reliability, reductions in size and weight, and energy conservation.

In an electrophotographic process, in general, a fixed image is formed by the following multiple steps: electrically forming an electrostatic image on a photosensitive member (i.e., image-holding member) including a photoconductive substance by any suitable method; developing the electrostatic image using a developer containing a toner; transferring the toner image formed on the photosensitive member to a recording medium, such as paper, directly or via an intermediate transfer body; and fixing the transferred image to the recording medium.

When a toner image is formed using a toner including a release agent, the release agent may crystallize and form domains in the toner image in which the release agent is unevenly distributed (hereinafter, these domains are referred to as "release agent domains"). Since the release agent domains are more brittle than a binder resin included in a toner, folding a toner image may cause cracking of the toner image when the release agent domains of the toner image are large.

Furthermore, when a toner image is formed on plural recording media, the recording media stacked on top of one another may be bonded to one another with the toner image. As a result, stacking may occur. It is considered that, when the recording media are left to stand while being stacked on top of one another after an image has been fixed thereon, the recording media fail to be cooled sufficiently and a binder resin included in the toner image is likely to remain softened. This presumably causes stacking.

SUMMARY

According to an aspect of the invention, there is provided a toner for developing an electrostatic image, the toner including toner particles, each of the toner particles including a binder resin and a release agent. The ratio B/A of a half-width B of an exothermic peak Tc resulting from the release agent, the exothermic peak Tc being determined in a first cooling step by differential scanning calorimetry, to a half-width A of an endothermic peak Tm resulting from the release agent, the endothermic peak Tm being determined in a first heating step prior to the first cooling step by differential scanning calorimetry, is 1.5 or more and 4 or less.

BRIEF DESCRIPTION OF THE DRAWINGS

Exemplary embodiments of the present invention will be described in detail based on the following figures, wherein.

DETAILED DESCRIPTION

Figure 1:
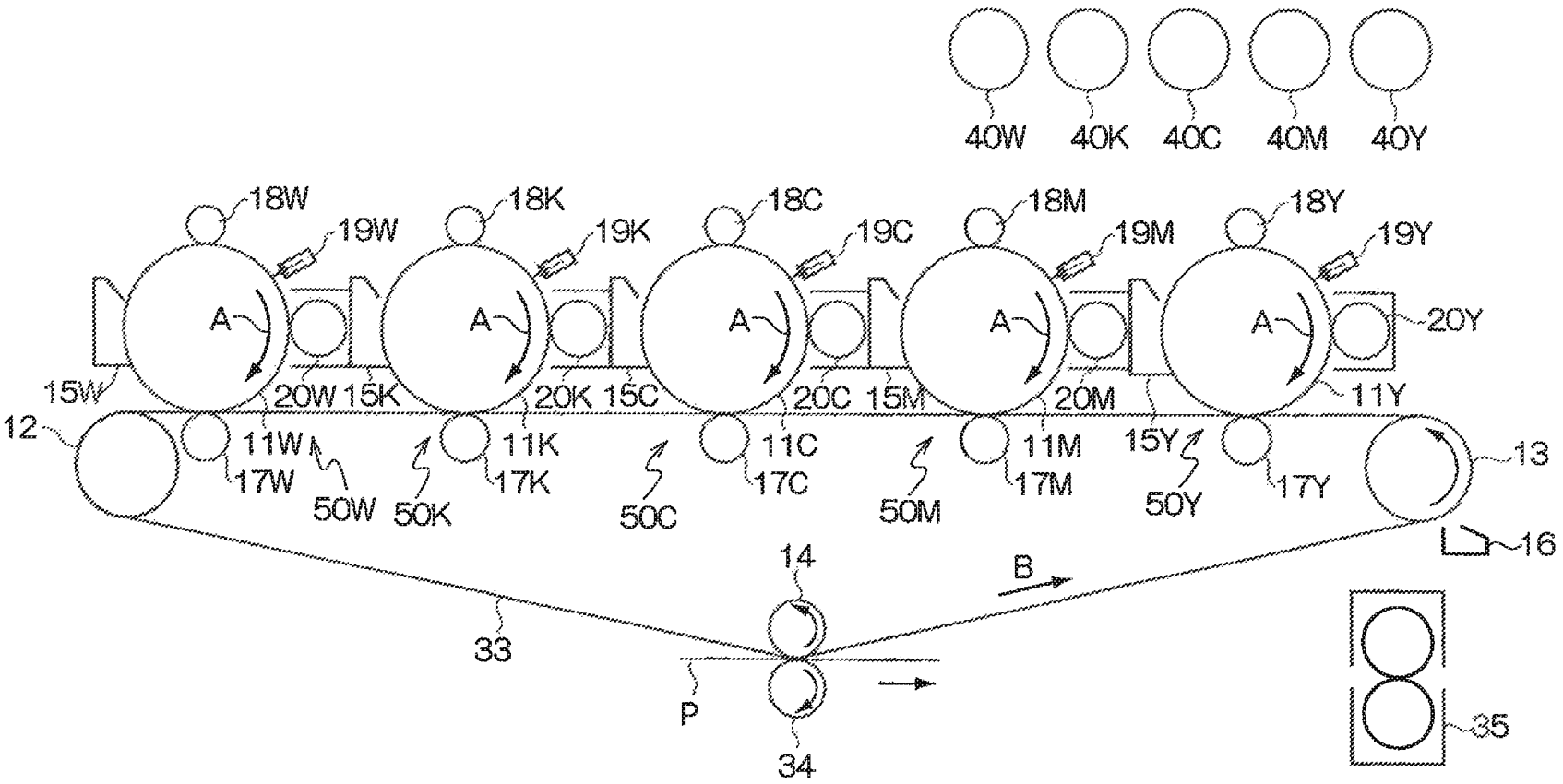
FIG. 1 is a diagram schematically illustrating an example of an image-forming apparatus according to an exemplary embodiment.

A toner for developing an electrostatic image, an electrostatic-image developer, a toner cartridge, a process cartridge, an image-forming apparatus, and an image-forming method according to exemplary embodiments are described below in detail.

Toner for Developing Electrostatic Image

The toner for developing an electrostatic image according to an exemplary embodiment (hereinafter, referred to simply as "toner") includes toner particles each including a binder resin and a release agent. The ratio B/A of a half-width B of an exothermic peak Tc resulting from the release agent which is determined in a first cooling step by differential scanning calorimetry to a half-width A of an endothermic peak Tm resulting from the release agent which is determined in a first heating step prior to the first cooling step by differential scanning calorimetry is 1.5 or more and 4 or less.

The toner according to the exemplary embodiment is capable of forming a toner image having high folding resistance and reducing the occurrence of stacking. The reasons for this are not clear, but considered to be as follows.

The term "stacking" used herein refers to a phenomenon that may occur when a toner image is sequentially formed on plural recording media in which the recording media on which the toner image has been formed are bonded to one another under a condition where the recording media are stacked on top of one another while having a high latent heat.

The inventors of the invention conducted extensive studies and, as a result, found that it is suitable to use the ratio B/A as a measure of the condition of the release agent domains included in a toner image.

Specifically, when a toner including a release agent is used, the release agent included in toner particles melted for the fixation of a toner image in the fixing step may recrystallize with a decrease in temperature. The presence of a substance that acts as a core in the toner image increases the likelihood of the recrystallization of the release agent.

In the case where the release agent domains are large, the substance that acts as a core is highly likely to be incorporated into the release agent domains. Even when the number of cores necessary for recrystallization is small, the proportion of release agent domains that include the cores is high. Therefore, in the case where the release agent domains are large, the constituents of the release agent domains are likely to be uniform.

On the other hand, in the case where the release agent domains are small, the recrystallization of the release agent domains requires a large amount of substance that acts as a core. Moreover, the likelihood of the substance that acts as a core being incorporated into the small release agent domains is small. In addition, the smaller the release agent domains, the larger the number of the release agent domains included in a toner image. As a result, the toner image includes both domains including the substance that acts as a core and domains that do not include the substance. This increases the nonuniformity in the constituents of the release agent domains.

The release agent domains and the binder resin form a sea-island structure in a toner image; the islands of the release agent domains are dispersed in the binder resin. Thus, it is considered that interfaces are formed between the surfaces of the release agent domains and the binder resin. Since the interfaces of the release agent domains are susceptible to the binder resin, the release agent is considered to be less likely to recrystallize in the vicinities of the interfaces of the release agent domains. It is considered that, the smaller the release agent domains, the larger the impact of the binder resin on the recrystallization of the release agent. It is considered that, the smaller the release agent domains, the larger the difference in the degree of recrystallization of the release agent among the domains and the larger the inconsistencies in the degree of recrystallization.

It is considered that the constituents of the release agent domains and the degree of recrystallization of the release agent domains vary depending on the state of dispersion of the release agent domains in the toner image (i.e., the size of the release agent domains). It is considered that, the larger the nonuniformity in the constituents of the release agent domains and the degree of recrystallization (i.e., the smaller the release agent domains), the larger the half-width of the exothermic peak resulting from the release agent.

Therefore, it is considered that, the larger the ratio B/A, the smaller the release agent domains, that is, the larger the degree of dispersion of the release agent domains in a toner image.

Examples of the substance capable of acting as a core include an inorganic substance and an organic substance that are solid during the fixation of a toner image. Examples of the inorganic substance include an inorganic pigment. Examples of the organic substance include an organic pigment.

While large release agent domains included in a toner image increase the likelihood of the toner image cracking when being folded, finely dispersing the release agent domains in a toner image may enhance the folding resistance of the toner image. It is considered that the release agent domains are finely dispersed in a toner image when the release agent domains are finely dispersed in a toner.

In the case where the release agent domains included in a toner image are large, both portions including a release agent and portions including a binder resin are present in the surface of the fixed image. While stacking is less likely occur in the portions including a release agent, stacking is likely to occur in the portions including a binder resin, in which the area at which the binder resin is exposed is large and the fixed image is likely to adhere to another recording medium.

In contrast, in the case where the release agent domains included in a toner image are small, the release agent exposed at the surface of the fixed image is also finely dispersed and a binder resin is finely partitioned although the area at which the binder resin is exposed to the surface of the fixed image is not changed. Accordingly, the portions at which the binder resin is exposed are also finely partitioned. This reduces adhesion strength. As a result, the occurrence of stacking may be reduced or, even if stacking occurs, the degree of stacking may be negligible and the fixed image is less likely to be degraded.

The thermal properties of the toner according to the exemplary embodiment, such as endothermic peak Tm and exothermic peak Tc, may be determined by differential scanning calorimetry (DSC).

The thermal properties of the toner may be determined by DSC in accordance with ASTM D3418-99 with a differential scanning calorimeter "DSC-60A" produced by Shimadzu Corporation. The temperature calibration of the detector of the differential scanning calorimeter is performed using the melting temperatures of indium and zinc. The amount of heat is calibrated using the heat of fusion of indium. The test sample is placed on an aluminum pan. An empty pan is also placed in the differential scanning calorimeter for comparison.

Specifically, 8 mg of a toner is placed on a sample holder of the differential scanning calorimeter "DSC-60A". The temperature is increased from 0° C. to 150° C. at a heating rate of 10° C./min for the first time (i.e., first heating step). The temperature is then maintained at 150° C. for 5 minutes. Subsequently, the temperature is reduced to 0° C. at a cooling rate of 10° C./min (i.e., the first cooling step). The temperature is then maintained at 0° C. for 5 minutes.

The temperature of the top of the endothermic peak Tm is determined from a peak that occurs in a DSC chart obtained in the first heating step. The temperature of the top of the exothermic peak Tc is determined from a peak that occurs in a DSC chart obtained in the first cooling step. The half-width of each peak is determined from the DSC chart.

The term "half-width" used herein refers to a full width at half maximum.

In the case where the toner according to the exemplary embodiment includes a crystalline resin, which is an optional component, endothermic and exothermic peaks resulting from the crystalline resin may occur in the DSC chart in addition to the endothermic and exothermic peaks resulting from a release agent. The method for determining whether the peaks that occur in the DSC chart result from a release agent or the crystalline resin is not limited.

Whether the peaks that occur in the DSC chart obtained in the first heating step result from a release agent or the crystalline resin may be determined by, for example, the following method.

The crystalline resin and the release agent are separated from each other by utilizing a difference in solubility in solvents therebetween. The separated components are identified by NMR, mass analysis, GPC, or the like. Examples of the solvent include tetrahydrofuran, diethyl ether, acetone, and methyl ethyl ketone. When tetrahydrofuran is used as a solvent, the crystalline resin is more soluble in tetrahydrofuran, while the release agent is less soluble in tetrahydrofuran. A DSC chart of each of the identified components in the first heating step is determined. It is possible to determine whether the endothermic peak that occurs in the DSC chart of the toner in the first heating step results from the release agent or the crystalline resin by comparing the endothermic peak that occurs in each chart with the DSC chart of the toner determined in the first heating step.

In the case where the endothermic peak that occurs in the DSC chart determined in the first heating step is a composite peak of the peak resulting from the release agent and the peak resulting from the crystalline resin, the method for separating the endothermic peaks resulting from the release agent and the crystalline resin from each other is not limited.

For example, it is possible to determine the endothermic peak resulting from the release agent by subtracting the endothermic peak resulting from the crystalline resin separated from the toner from the composite peak. The half-width of the endothermic peak resulting from the release agent is used as a half-width A of the endothermic peak Tm according to the exemplary embodiment.

In the case where the exothermic peak that occurs in the DSC chart determined in the first cooling step is a composite peak of the peak resulting from the release agent and the peak resulting from the crystalline resin, the method for separating the exothermic peaks resulting from the release agent and the crystalline resin from each other is not limited.

(i) A case where the temperature of the top of the endothermic peak resulting from the crystalline resin is lower than the temperature of the top of the endothermic peak resulting from the release agent by 8° C. or more in the DSC chart determined in the first heating step In this case, the temperature of the top of a crest present between the endothermic peak resulting from the crystalline resin and the endothermic peak resulting from the release agent in the DSC chart of the toner determined in the first heating step is measured. Subsequently, the temperature of the toner is increased from 0° C. to the temperature of the top of the crest and then maintained to be the temperature of the top of the crest for 5 minutes. The temperature is then reduced to 0° C. at a cooling rate of 10° C./min. A DSC chart of the toner is determined during the above process. It is considered that heating the toner to the temperature of the top of the crest of the DSC chart determined in the first heating step causes the crystalline resin included in the toner to melt but does not cause the release agent to melt. Thus, when the toner is subsequently cooled, the exothermic peak resulting from the crystalline resin is considered to occur in the DSC chart.

The exothermic peak resulting from the release agent can be determined by subtracting the exothermic peak resulting from the crystalline resin from the composite peak. The half-width of the calculated exothermic peak is used as a half-width B of the exothermic peak Tc according to the exemplary embodiment.

(ii) A case where, in the DSC chart determined in the first heating step, the difference between the temperature of the top of the endothermic peak resulting from the crystalline resin and the temperature of the top of the endothermic peak resulting from the release agent is less than 8° C.

An example of the method for determining exothermic peak when the difference between the temperatures of the endothermic peaks is small is, but not limited to, the following.

The release agent is separated by utilizing the difference in solubility in solvents between the release agent and the binder resin in order to compare the amount of heat of the endothermic peak between the release agent and the crystalline resin included in the toner. After the release agent has been separated, the components of the toner which are other than the release agent are measured by DSC in order to determine the amount of heat of the endothermic peak of the crystalline resin. Prior to the DSC measurement, the components of the toner which are other than the release agent are heated at a temperature higher than the glass-transition temperature of the toner by 5° C. to 10° C. for 1 hour. When the amount of heat of the endothermic peak of the crystalline resin is measured, separation is performed in the DSC measurement without changing the proportions of the components of the toner which are other than the release agent. In another case, the amount of heat of the endothermic peak of the crystalline resin may be calculated on the basis of the compositional proportions.

Subsequently, the amount of heat of the endothermic peak resulting from the release agent included in the toner is determined by comparing the amount of heat of the endothermic peak of the entire toner with the amount of heat of the endothermic peak of the crystalline resin which is determined above.

Then, the amount of heat of the exothermic peak is confirmed using the DSC chart of the original toner determined by DSC in the cooling step. When plural exothermic peaks occur, the amounts of heat of endothermic peaks are compared with the amounts of heat of exothermic peaks, and a peak having a closer amount of heat is considered to be the peak resulting from the crystalline resin or the release agent.

When a composite peak occurs, subtracting the exothermic peak resulting from the crystalline resin from the composite peak gives an exothermic peak resulting from the release agent. The half-width of the calculated exothermic peak is used as a half-width B of the exothermic peak Tc according to the exemplary embodiment.

In the exemplary embodiment, the difference between the temperature of the top of the endothermic peak Tm and the temperature of the top of the exothermic peak Tc is preferably 8° C. or more and 25° C. or less, is more preferably 8° C. or more and 20° C. or less, and is further preferably 8° C. or more and 17° C. or less.

When the difference between the endothermic peak Tm and the exothermic peak Tc is 8° C. or more and 25° C. or less, the occurrence of stacking may be further reduced. When the difference between the endothermic peak Tm and the exothermic peak Tc is 8° C. or more, the release agent particles are finely dispersed, which may enhance the stacking resistance. When the difference between the endothermic peak Tm and the exothermic peak Tc is 25° C. or less, the size of the release agent domains is sufficiently large. This may enhance releasability.

In the exemplary embodiment, the temperature of the top of the endothermic peak Tm is preferably 60° C. or more and 110° C. or less, is more preferably 65° C. or more and 100° C. or less, and is further preferably 70° C. or more and 95° C. or less.

When the temperature of the top of the endothermic peak Tm is 60° C. or more and 110° C. or less, the occurrence of stacking may be further reduced. Limiting the temperature of the top of the endothermic peak Tm to be 60° C. or more may enhance the storage stability of the toner. Limiting the temperature of the top of the endothermic peak Tm to be 110° C. or less may enhance the capability of being fixed with a small amount of energy, that is, the low-temperature fixability.

The content of the specific-heat substance having a specific heat of 0.1 kJ/(kg·K) or more and 1.0 kJ/(kg·K) or less is determined as follows.

The toner particles to be measured are charged into an Erlenmeyer flask. After THF has been charged to the flask, the flask is sealed and left to stand 24 hours. The resulting mixture is transferred into a centrifuge glass tube. THF is again charged into the Erlenmeyer flask in order to wash the flask and then transferred into the centrifuge glass tube, which is then hermetically sealed. Subsequently, centrifugation is performed with a number of rotation of 20,000 rpm and −10° C. for 30 minutes. After centrifugation has been performed, the contents are removed from the glass tube and left to stand. Subsequently, the supernatant is removed. The THF-insoluble component of the entire toner particles is separated.

The THF-insoluble component is heated to 600° C. under a stream of nitrogen at a heating rate of 20° C./min. In the early stage of the heating process, the release agent is volatized. Subsequently, a solid component derived from the resin component is decomposed by pyrolysis. The remaining organic components, such as a component derived from the colorant (i.e., the pigment), are decomposed by pyrolysis when heating is continued after the atmosphere has been changed to an air. The remaining ash component is the solid component derived from the inorganic component, which is considered to be the specific-heat substance included in the toner particles. The content of the specific-heat substance in the toner particles is determined on the basis of the proportion of the solid component.

The toner according to the exemplary embodiment is described in detail below.

The toner according to the exemplary embodiment includes toner particles and, as needed, an external additive.

Toner Particles

The toner particles include, for example, a binder resin and a release agent and may further include a colorant and other additives.

Binder Resin

Examples of the binder resin include vinyl resins that are homopolymers of the following monomers or copolymers of two or more monomers selected from the following monomers: styrenes (e.g., styrene, para-chlorostyrene, and α-methylstyrene), (meth)acrylates (e.g., methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (e.g., acrylonitrile and methacrylonitrile), vinyl ethers (e.g., vinyl methyl ether and vinyl isobutyl ether), vinyl ketones (e.g., vinyl methyl ketone, vinyl ethyl ketone, and vinyl isopropenyl ketone), and olefins (e.g., ethylene, propylene, and butadiene).

Examples of the binder resin further include non-vinyl resins such as epoxy resins, polyester resins, polyurethane resins, polyamide resins, cellulose resins, polyether resins, and modified rosins; a mixture of the non-vinyl resin and the vinyl resin; and a graft polymer produced by polymerization of the vinyl monomer in the presence of the non-vinyl resin.

The above binder resins may be used alone or in combination of two or more.

The binder resin may be a polyester resin.

Examples of the polyester resin include amorphous polyester resins known in the related art. A crystalline polyester resin may be used as a polyester resin in combination with an amorphous polyester resin. In such a case, the content of the crystalline polyester resin in the binder resin may be set to 2% by mass or more and 40% by mass or less and is preferably set to 2% by mass or more and 20% by mass or less.

The term "crystalline" resin used herein refers to a resin that, in thermal analysis using differential scanning calorimetry (DSC), exhibits a distinct endothermic peak instead of step-like endothermic change and specifically refers to a resin that exhibits an endothermic peak with a half-width of 10° C. or less at a heating rate of 10° C./min.

On the other hand, the term "amorphous" resin used herein refers to a resin that exhibits an endothermic peak with a half-width of more than 10° C., that exhibits step-like endothermic change, or that does not exhibit a distinct endothermic peak.

Amorphous Polyester Resin

Examples of the amorphous polyester resin include condensation polymers of a polyvalent carboxylic acid and a polyhydric alcohol. The amorphous polyester resin may be a commercially available one or a synthesized one.

Examples of the polyvalent carboxylic acid include aliphatic dicarboxylic acids (e.g., oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, and naphthalenedicarboxylic acid), anhydrides of these dicarboxylic acids, and lower (e.g., 1 to 5 carbon atoms) alkyl esters of these dicarboxylic acids. Among these dicarboxylic acids, for example, aromatic dicarboxylic acids may be used as a polyvalent carboxylic acid.

Trivalent or higher multivalent carboxylic acids having a crosslinked structure or a branched structure may be used as a polyvalent carboxylic acid in combination with the dicarboxylic acids. Examples of the trivalent or higher multivalent carboxylic acids include trimellitic acid, pyromellitic acid, anhydrides of these carboxylic acids, and lower (e.g., 1 to 5 carbon atoms) alkyl esters of these carboxylic acids.

The above-described polyvalent carboxylic acids may be used alone or in combination of two or more.

Examples of the polyhydric alcohol include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexanedimethanol, and hydrogenated bisphenol A), and aromatic diols (e.g., bisphenol A-ethylene oxide adduct and bisphenol A-propylene oxide adduct). Among these diols, for example, aromatic diols and alicyclic diols may be used as a polyhydric alcohol. In particular, aromatic diols may be used as a polyhydric alcohol.

Trihydric or higher polyhydric alcohols having a crosslinked structure or a branched structure may be used as a polyhydric alcohol in combination with the diols. Examples of the trihydric or higher polyhydric alcohols include glycerin, trimethylolpropane, and pentaerythritol.

The above-described polyhydric alcohols may be used alone or in combination of two or more.

The glass transition temperature Tg of the amorphous polyester resin is preferably 50° C. or more and 80° C. or less and is more preferably 50° C. or more and 65° C. or less.

The glass transition temperature is determined from a DSC curve obtained by differential scanning calorimetry (DSC). More specifically, the glass transition temperature is determined from the "extrapolated glass-transition-starting temperature" according to a method for determining glass transition temperature which is described in JIS K 7121-1987 "Testing Methods for Transition Temperatures of Plastics".

The weight-average molecular weight Mw of the amorphous polyester resin is preferably 5,000 or more and 1,000,000 or less and is more preferably 7,000 or more and 500,000 or less.

The number-average molecular weight Mn of the amorphous polyester resin is preferably 2,000 or more and 100,000 or less.

The molecular weight distribution index Mw/Mn of the amorphous polyester resin is preferably 1.5 or more and 100 or less and is more preferably 2 or more and 60 or less.

The weight-average molecular weight and number-average molecular weight of the amorphous polyester resin are determined by gel permeation chromatography (GPC). Specifically, the molecular weights of the amorphous polyester resin are determined by GPC using a "HLC-8120GPC" produced by Tosoh Corporation as measuring equipment, a column "TSKgel SuperHM-M (15 cm)" produced by Tosoh Corporation, and a tetrahydrofuran (THF) solvent. The weight-average molecular weight and number-average molecular weight of the amorphous polyester resin are determined on the basis of the results of the measurement using a molecular-weight calibration curve based on monodisperse polystyrene standard samples.

The amorphous polyester resin may be produced by any suitable production method known in the related art. Specifically, the amorphous polyester resin may be produced by, for example, a method in which polymerization is performed at 180° C. or more and 230° C. or less and the pressure inside the reaction system is reduced as needed while water and alcohols that are generated by condensation are removed.

In the case where the raw materials, that is, the monomers, are not dissolved in or compatible with each other at the reaction temperature, a solvent having a high boiling point may be used as a dissolution adjuvant in order to dissolve the raw materials. In such a case, the condensation polymerization reaction is performed while the dissolution adjuvant is distilled away. In the case where monomers used for copolymerization have low compatibility with each other, a condensation reaction of the monomers with an acid or alcohol that is to undergo a polycondensation reaction with the monomers may be performed in advance and subsequently a polycondensation of the resulting polymers with the main components may be performed.

Crystalline Polyester Resin

Examples of the crystalline polyester resin include condensation polymers of a polyvalent carboxylic acid and a polyhydric alcohol. The crystalline polyester resin may be commercially available one or a synthesized one.

A condensation polymer prepared from polymerizable monomers including linear aliphatic monomers may be used as a crystalline polyester resin instead of a condensation polymer prepared from polymerizable monomers including aromatic monomers in order to increase ease of forming a crystal structure.

Examples of the polyvalent carboxylic acid include aliphatic dicarboxylic acids (e.g., oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid), aromatic dicarboxylic acids (e.g., dibasic acids such as phthalic acid, isophthalic acid, terephthalic acid, and naphthalene-2,6-dicarboxylic acid), anhydrides of these dicarboxylic acids, and lower (e.g., 1 to 5 carbon atoms) alkyl esters of these dicarboxylic acids.

Trivalent or higher polyvalent carboxylic acids having a crosslinked structure or a branched structure may be used as a polyvalent carboxylic acid in combination with the dicarboxylic acids. Examples of the trivalent carboxylic acids include aromatic carboxylic acids (e.g., 1,2,3-benzenetricarboxylic acid, 1,2,4-benzenetricarboxylic acid, and 1,2,4-naphthalenetricarboxylic acid), anhydrides of these tricarboxylic acids, and lower (e.g., 1 to 5 carbon atoms) alkyl esters of these tricarboxylic acids.

Dicarboxylic acids including a sulfonic group and dicarboxylic acids including an ethylenic double bond may be used as a polyvalent carboxylic acid in combination with the above dicarboxylic acids.

The above-described polyvalent carboxylic acids may be used alone or in combination of two or more.

Examples of the polyhydric alcohol include aliphatic diols (e.g., linear aliphatic diols including a main chain having 7 to 20 carbon atoms). Examples of the aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among these aliphatic diols, 1,8-octanediol, 1,9-nonanediol, and 1,10-decanediol may be used.

Trihydric or higher polyhydric alcohols having a crosslinked structure or a branched structure may be used as a polyhydric alcohol in combination with the above diols. Examples of the trihydric or higher polyhydric alcohols include glycerin, trimethylolethane, trimethylolpropane, and pentaerythritol.

The above-described polyhydric alcohols may be used alone or in combination of two or more.

The content of the aliphatic diols in the polyhydric alcohol may be 80 mol % or more and is preferably 90 mol % or more.

The melting temperature of the crystalline polyester resin is preferably 50° C. or more and 100° C. or less, is more preferably 55° C. or more and 90° C. or less, and is further preferably 60° C. or more and 85° C. or less.

The melting temperature of the crystalline polyester resin is determined from the "melting peak temperature" according to a method for determining melting temperature which is described in JIS K 7121-1987 "Testing Methods for Transition Temperatures of Plastics" using a DSC curve obtained by differential scanning calorimetry (DSC).

The crystalline polyester resin may have a weight-average molecular weight Mw of 6,000 or more and 35,000 or less.

The crystalline polyester resin may be produced by any suitable method known in the related art similarly to the amorphous polyester resin.

The content of the binder resin in the toner particles is, for example, preferably 40% by mass or more and 95% by mass or less, is more preferably 50% by mass or more and 90% by mass or less, and is further preferably 60% by mass or more and 85% by mass or less.

Colorant

The toner according to the exemplary embodiment may include, as a colorant, at least one selected from an inorganic pigment and a metal pigment. Inorganic pigments and metal pigments have a smaller specific heat than organic pigments included in the color toners used in the related art. When the toner according to the exemplary embodiment includes at least one selected from an inorganic pigment and a metal pigment having a small specific heat, the temperature of the inorganic pigment or metal pigment becomes high even when the amount of heat applied is equal. Accordingly, the insides of the toner particles are likely to have a high temperature. Since the toner particles have a high temperature, the release agent is melted. When the finely dispersed release agent domains do not include an organic pigment that serves as a core, the likelihood of recrystallization of the release agent domains is reduced. As a result, a toner that does not include an organic pigment but includes at least one selected from an inorganic pigment and a metal pigment is considered to reduce the recrystallization temperature of the release agent compared with color toners used in the related art which include an organic pigment.

Examples of metal pigments used in the exemplary embodiment include particles of a metal, such as aluminum, brass, bronze, nickel, stainless steel, and zinc. In the case where the toner according to the exemplary embodiment is used as a "metallic toner", the metal pigment used in the exemplary embodiment may be aluminum particles.

Examples of a substance used as an inorganic pigment in the exemplary embodiment include titanium oxide (i.e., titania), silica, alumina, calcium carbonate, aluminum hydroxide, satin white, talc, calcium sulfate, magnesium oxide, magnesium carbonate, white carbon, kaolin, aluminosilicate, sericite, bentonite, and smectite. In the case where the toner according to the exemplary embodiment is used as a "white toner", the inorganic pigment used in the exemplary embodiment may be titanium oxide particles.

The shape of particles of the metal pigment and the inorganic pigment is not limited and may be, for example, flat.

The toner according to the exemplary embodiment may further include a colorant other than the above inorganic pigment and metal pigment. Examples of the other colorant include an organic pigment and an organic dye.

Examples of the other colorant include organic pigments such as Carbon Black, Chrome Yellow, Hansa Yellow, Benzidine Yellow, Threne Yellow, Quinoline Yellow, Pigment Yellow, Permanent Orange GTR, Pyrazolone Orange, Vulcan Orange, Watching Red, Permanent Red, Brilliant Carmine 3B, Brilliant Carmine 6B, DuPont Oil Red, Pyrazolone Red, Lithol Red, Rhodamine B Lake, Lake Red C, Pigment Red, Rose Bengal, Aniline Blue, Cobalt Blue, Calco Oil Blue, Methylene Blue Chloride, Phthalocyanine Blue, Pigment Blue, Phthalocyanine Green, and Malachite Green Oxalate; and organic dyes such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, and thiazole dyes.

The colorant may optionally be subjected to a surface treatment and may be used in combination with a dispersant. Plural types of colorants may be used in combination.

The content of the specific-heat substance in the toner particles is preferably, for example, 10% by mass or more and 45% by mass or less and is more preferably 20% by mass or more and 35% by mass or less.

Release Agent

Examples of the release agent include, but are not limited to, hydrocarbon waxes such as a paraffin wax, a Fischer-Tropsch wax, and a polyethylene wax; natural waxes such as a carnauba wax, a rice bran wax, and a candelilla wax; synthetic or mineral-petroleum-derived waxes such as a montan wax; ester waxes such as a fatty-acid ester wax and a montanate wax; and amide waxes such as stearic acid amide.

The release agent may include a paraffin wax, a Fischer-Tropsch wax, a polyethylene wax, an ester wax, or an amide wax.

The melting temperature of the release agent is preferably 60° C. or more and 110° C. or less and is more preferably 60° C. or more and 100° C. or less.

The melting temperature of the release agent is determined from the "melting peak temperature" according to a method for determining melting temperature which is described in JIS K-7121-1987 "Testing Methods for Transition Temperatures of Plastics" using a DSC curve obtained by differential scanning calorimetry (DSC).

The content of the release agent in the toner particles is preferably, for example, 1% by mass or more and 20% by mass or less and is more preferably 5% by mass or more and 15% by mass or less.

Other Additives

Examples of the other additives include additives known in the related art, such as a magnetic substance, a charge-controlling agent, and an inorganic powder. These additives may be added to the toner particles as internal additives.

Properties, Etc. Of Toner Particles

The toner particles may have a single-layer structure or a "core-shell" structure constituted by a core (i.e., core particle) and a coating layer (i.e., shell layer) covering the core.

The core-shell structure of the toner particles may be constituted by, for example, a core including a binder resin and, as needed, other additives such as a colorant and a release agent and by a coating layer including the binder resin.

The volume-average diameter D50v of the toner particles is preferably 2 μm or more and 15 μm or less and is more preferably 4 μm or more and 12 μm or less.

The above-described average diameters and particle diameter distribution indices of the toner particles are measured using "COULTER Multisizer II" (produced by Beckman Coulter, Inc.) with an electrolyte "ISOTON-II" (produced by Beckman Coulter, Inc.) in the following manner.

A sample to be measured (0.5 mg or more and 50 mg or less) is added to 2 ml of a 5%-aqueous solution of a surfactant (e.g., sodium alkylbenzene sulfonate) that serves as a dispersant. The resulting mixture is added to 100 ml or more and 150 ml or less of an electrolyte.

The resulting electrolyte containing the sample suspended therein is subjected to a dispersion treatment for 1 minute using an ultrasonic disperser, and the distribution of the diameters of particles having a diameter of 2 μm or more and 60 μm or less is measured using COULTER Multisizer II with an aperture having a diameter of 100 m. The number of the particles sampled is 50,000.

The particle diameter distribution measured is divided into a number of particle diameter ranges (i.e., channels). For each range, in ascending order in terms of particle diameter, the cumulative volume and the cumulative number are calculated and plotted to draw cumulative distribution curves. Particle diameters at which the cumulative volume and the cumulative number reach 16% are considered to be the volume particle diameter D16v and the number particle diameter D16p, respectively. Particle diameters at which the cumulative volume and the cumulative number reach 50% are considered to be the volume-average particle diameter D50v and the number-average particle diameter D50p, respectively. Particle diameters at which the cumulative volume and the cumulative number reach 84% are considered to be the volume particle diameter D84v and the number particle diameter D84p, respectively.

Using the volume particle diameters and number particle diameters measured, the volume-average particle diameter distribution index (GSDv) is calculated as $(D84v/D16v)^{1/2}$ and the number-average particle diameter distribution index (GSDp) is calculated as $(D84p/D16p)^{1/2}$.

The toner particles preferably has an average circularity of 0.94 or more and 1.00 or less. The average circularity of the toner particles is more preferably 0.95 or more and 0.98 or less.

The average circularity of the toner particles is determined as [Equivalent circle perimeter]/[Perimeter](i.e., [Perimeter of a circle having the same projection area as the particles]/[Perimeter of the projection image of the particles]. Specifically, the average circularity of the toner particles is determined by the following method.

The toner particles to be measured are sampled by suction so as to form a flat stream. A static image of the particles is taken by instantaneously flashing a strobe light. The image of the particles is analyzed with a flow particle image analyzer "FPIA-3000" produced by Sysmex Corporation. The number of samples used for determining the average circularity of the toner particles is 3500.

In the case where the toner includes an external additive, the toner (i.e., the developer) to be measured is dispersed in water containing a surfactant and then subjected to an ultrasonic wave treatment in order to remove the external additive from the toner particles.

External Additive

Examples of the external additive include inorganic particles such as $SiO_2$ particles, $TiO_2$ particles, $Al_2O_3$ particles, CuO particles, ZnO particles, $SnO_2$ particles, $CeO_2$ particles, $Fe_2O_3$ particles, MgO particles, BaO particles, CaO particles, $K_2O$ particles, $Na_2O$ particles, $ZrO_2$ particles, CaO. $SiO_2$ particles, $K_2O$. $(TiO_2)_n$ particles, $Al_2O_3.2SiO_2$ particles, $CaCO_3$ particles, $MgCO_3$ particles, $BaSO_4$ particles, and $MgSO_4$ particles.

The surfaces of the inorganic particles used as the external additive may be hydrophobized. The surfaces of the inorganic particles can be hydrophobized by, for example, immersing the inorganic particles in a hydrophobizing agent. Examples of the hydrophobizing agent include, but are not particularly limited to, a silane coupling agent, silicone oil, a titanate coupling agent, and aluminium coupling agent. These hydrophobizing agents may be used alone or in combination of two or more.

In general, the amount of the hydrophobizing agent is set to, for example, 1 part by mass or more and 10 parts by mass or less relative to 100 parts by mass of the inorganic particles.

Examples of the external additive also include resin particles (e.g., polystyrene particles, poly(methyl methacrylate) (PMMA) particles, and melamine particles) and cleaning activators (particles of a metal salt of a higher fatty acid, such as zinc stearate, and particles of a fluorine-based polymer).

The amount of the external additive is, for example, preferably 0.01% by mass or more and 5% by mass or less and is more preferably 0.01% by mass or more and 2.0% by mass or less of the amount of the toner particles.

Method for Producing Toner

A method for producing the toner according to the exemplary embodiment is described below.

The toner according to the exemplary embodiment is produced by, after the preparation of the toner particles, depositing an external additive on the surfaces of the toner particles.

The toner particles may be prepared by any dry process (e.g., knead pulverization) or any wet process (e.g., aggregation coalescence, suspension polymerization, or dissolution suspension). However, a method for preparing the toner particles is not particularly limited thereto, and any suitable method known in the related art may be used.

Among these methods, aggregation coalescence may be employed in order to prepare the toner particles.

Specifically, in the case where, for example, aggregation coalescence is employed in order to prepare the toner particles, the toner particles are prepared by the following steps:

preparing a resin particle dispersion in which resin particles serving as a binder resin are dispersed (i.e., resin particle dispersion preparation step);

causing the resin particles (and, as needed, other particles) to aggregate together in the resin particle dispersion (or in the resin particle dispersion mixed with another particle dispersion as needed) in order to form aggregated particles (i.e., aggregated particle formation step);

and heating the resulting aggregated particle dispersion in which the aggregated particles are dispersed in order to cause fusion and coalescence of the aggregated particles to occur and thereby form toner particles (fusion-coalescence step).

The above-described steps are each described below in detail.

Hereinafter, a method for preparing toner particles including a colorant is described. However, it should be noted that the colorant is optional. It is needless to say that additives other than a colorant may be used.

Resin Particle Dispersion Preparation Step

In addition to a resin particle dispersion in which resin particles serving as a binder resin are dispersed, for example, a colorant particle dispersion in which colorant particles are dispersed and a release-agent particle dispersion in which release-agent particles are dispersed are prepared.

The resin particle dispersion is prepared by, for example, dispersing resin particles in a dispersion medium using a surfactant.

Examples of the dispersion medium used for preparing the resin particle dispersion include aqueous media.

Examples of the aqueous media include water such as distilled water and ion-exchange water and alcohols. These aqueous media may be used alone or in combination of two or more.

Examples of the surfactant include anionic surfactants such as sulfate-based surfactants, sulfonate-based surfactants, and phosphate-based surfactants; cationic surfactants such as amine-salt-based surfactants and quaternary-ammonium-salt-based surfactants; and nonionic surfactants such as polyethylene-glycol surfactants, alkylphenol-ethylene-oxide-adduct-based surfactants, and polyhydric-alcohol-based surfactants. Among these surfactants, in particular, the anionic surfactants and the cationic surfactants may be used. The nonionic surfactants may be used in combination with the anionic surfactants and the cationic surfactants.

These surfactants may be used alone or in combination of two or more.

In the preparation of the resin particle dispersion, the resin particles can be dispersed in a dispersion medium by any suitable dispersion method commonly used in the related art in which, for example, a rotary-shearing homogenizer, a ball mill, a sand mill, or a dyno mill that includes media is used. Depending on the type of the resin particles used, the resin particles may be dispersed in the resin particle dispersion by, for example, phase-inversion emulsification.

Phase-inversion emulsification is a method in which the resin to be dispersed is dissolved in a hydrophobic organic solvent in which the resin is soluble, a base is added to the resulting organic continuous phase (i.e., O phase) to perform neutralization, subsequently an aqueous medium (i.e., W phase) is charged to convert the resin from W/O to O/W, that is, phase inversion, in order to create a discontinuous phase, and thereby the resin is dispersed in the aqueous medium in the form of particles.

The volume-average diameter of the resin particles dispersed in the resin particle dispersion is preferably, for example, 0.01 μm or more and 1 μm or less, is more preferably 0.08 μm or more and 0.8 μm or less, and is further preferably 0.1 μm or more and 0.6 μm or less.

The volume-average diameter of the resin particles is determined in the following manner. The particle diameter distribution of the resin particles is obtained using a laser-diffraction-type particle-size-distribution measurement apparatus (e.g., "LA-700" produced by HORIBA, Ltd.). The particle diameter distribution measured is divided into a number of particle diameter ranges (i.e., channels). For each range, in ascending order in terms of particle diameter, the cumulative volume is calculated and plotted to draw a cumulative distribution curve. A particle diameter at which the cumulative volume reaches 50% is considered to be the volume particle diameter D50v. The volume-average diameters of particles included in the other dispersions are also determined in the above-described manner.

The content of the resin particles included in the resin particle dispersion is preferably, for example, 5% by mass or more and 50% by mass or less and is more preferably 10% by mass or more and 40% by mass or less.

The colorant particle dispersion, the release-agent particle dispersion, and the like are also prepared as in the preparation of the resin particle dispersion. In other words, the above-described specifications for the volume-average diameter of the particles included in the resin particle dispersion, the dispersion medium of the resin particle dispersion, the dispersion method used for preparing the resin particle dispersion, and the content of the particles in the resin particle dispersion can also be applied to colorant particles dispersed in the colorant particle dispersion and release-agent particles dispersed in the release-agent particle dispersion.

Aggregated Particle Formation Step

The resin particle dispersion is mixed with the colorant particle dispersion and the release-agent particle dispersion.

In the resulting mixed dispersion, heteroaggregation of the resin particles with the colorant particles and the release-agent particles is performed in order to form aggregated particles including the resin particles, the colorant particles, and the release-agent particles, the aggregated particles having a diameter close to that of the desired toner particles.

Specifically, for example, a flocculant is added to the mixed dispersion, and the pH of the mixed dispersion is controlled to be acidic (e.g., pH of 1.5 or more and 2.9 or less). A dispersion stabilizer may be added to the mixed dispersion as needed. Subsequently, the mixed dispersion is heated to the glass transition temperature of the resin particles (specifically, e.g., [glass transition temperature of the resin particles −30° C.] or more and [the glass transition temperature −10° C.] or less), and thereby the particles dispersed in the mixed dispersion are caused to aggregate together to form aggregated particles.

In the aggregated particle formation step, alternatively, for example, the above-described flocculant may be added to the mixed dispersion at room temperature (e.g., 25° C.) while the mixed dispersion is stirred using a rotary-shearing homogenizer. Then, the pH of the mixed dispersion is controlled to be acidic (e.g., pH of 1.5 or more and 2.9 or less), and a dispersion stabilizer may be added to the mixed dispersion as needed. Subsequently, the mixed dispersion is heated in the above-described manner.

When the pH of the mixed dispersion is 1.5 or more and 2.9 or less, the cohesive force produced by the flocculant is increased. This increases the likelihood of the components of the toner particles to be uniformly distributed but also increases the occurrence of coarse powder particles in the toner particles. In order to reduce the occurrence of the coarse powder particles, the concentration of the flocculant may be reduced to 1% or less in terms of active solid content, and the flocculant is added to the mixed dispersion in small amounts.

Examples of the flocculant include surfactants, inorganic metal salts, and divalent or higher polyvalent metal complexes that have a polarity opposite to that of the surfactant that is added to the mixed dispersion as a dispersant. In particular, using a metal complex as a flocculant reduces the amount of surfactant used and, as a result, charging characteristics may be enhanced.

An additive capable of forming a complex or a bond similar to a complex with the metal ions contained in the flocculant such as a chelating agent may optionally be used.

Examples of the inorganic metal salts include metal salts such as calcium chloride, calcium nitrate, barium chloride, magnesium chloride, zinc chloride, aluminium chloride, and aluminium sulfate; and inorganic metal salt polymers such as polyaluminium chloride, polyaluminium hydroxide, and calcium polysulfide.

The chelating agent may be a water-soluble chelating agent. Examples of such a chelating agent include oxycarboxylic acids such as tartaric acid, citric acid, and gluconic acid, imino diacid (IDA), nitrilotriacetic acid (NTA), and ethylenediaminetetraacetic acid (EDTA).

The amount of the chelating agent used is preferably 0.01 parts by mass or more and 5.0 parts by mass or less and is more preferably 0.1 parts by mass or more and less than 3.0 parts by mass relative to 100 parts by mass of the resin particles.

Fusion-Coalescence Step

The aggregated particle dispersion in which the aggregated particles are dispersed is heated to, for example, the glass transition temperature of the resin particles or more (e.g., temperature higher than the glass transition temperature of the resin particles by 10° C. to 30° C.) in order to perform fusion and coalescence of the aggregated particles. Thus, toner particles are prepared.

In order to suppress the growth of the release agent domains, the temperature at which heating is performed in the fusion-coalescence step may be set to be lower than the melting temperature of the release agent by about 20° C. Performing fusion and coalescence at a temperature lower than the melting temperature of the release agent by about 20° C. suppresses the growth of the release agent domains included in the toner particles.

Since reducing the fusion-coalescence temperature reduces the speed at which the shape of the toner particles changes, the amount of acid component may be increased in order to promote coalescence. However, increasing the amount of acid component added may result in the occurrence of coarse powder particles in the toner particles. In order to reduce the occurrence of the coarse powder particles, the concentration of the acid added may be reduced to be 0.01 M or more and 0.5 M or less.

The toner particles are prepared through the above-described steps.

It is also possible to prepare the toner particles by, after preparing the aggregated particle dispersion in which the aggregated particles are dispersed, further mixing the aggregated particle dispersion with a resin particle dispersion in which resin particles are dispersed and subsequently performing aggregation such that the resin particles are deposited on the surfaces of the aggregated particles in order to form second aggregated particles; and by heating the resulting second-aggregated particle dispersion in which the second aggregated particles are dispersed and thereby causing fusion and coalescence of the second aggregated particles to occur in order to form toner particles having a core-shell structure.

After the completion of the fusion-coalescence step, the toner particles formed in the solution are subjected to any suitable cleaning step, solid-liquid separation step, and drying step that are known in the related art in order to obtain dried toner particles.

In the cleaning step, the toner particles may be subjected to displacement washing using ion-exchange water to a sufficient degree from the viewpoint of electrification characteristics. Examples of a solid-liquid separation method employed in the solid-liquid separation step include, but are not limited to, suction filtration and pressure filtration from the viewpoint of productivity. Examples of a drying method employed in the drying step include, but are not particularly limited to, freeze-drying, flash-jet drying, fluidized drying, and vibrating fluidized drying from the viewpoint of productivity.

The toner according to the exemplary embodiment is produced by, for example, adding an external additive to the dried toner particles and mixing the resulting toner particles using a V-blender, a Henschel mixer, a Lodige mixer, or the like. Optionally, coarse toner particles may be removed using a vibrating screen classifier, a wind screen classifier, or the like.

Electrostatic-Image Developer

The electrostatic-image developer according to an exemplary embodiment includes at least the toner according to the above-described exemplary embodiment.

The electrostatic-image developer according to the exemplary embodiment may be a monocomponent developer including only the above-described toner or may be a two-component developer that is a mixture of the above-described toner and a carrier.

The type of the carrier is not particularly limited, and any suitable carrier known in the related art may be used. Examples of the carrier include a coated carrier prepared by coating the surfaces of cores including magnetic powder particles with a coat resin; a magnetic-powder-dispersed carrier prepared by dispersing and mixing magnetic powder particles in a matrix resin; and a resin-impregnated carrier prepared by impregnating a porous magnetic powder with a resin.

The magnetic-powder-dispersed carrier and the resin-impregnated carrier may also be prepared by coating particles constituting the carrier, that is, core particles, with a coat resin.

Examples of the magnetic powder include powders of magnetic metals such as iron, nickel, and cobalt; and powders of magnetic oxides such as ferrite and magnetite.

Examples of the coat resin and the matrix resin include polyethylene, polypropylene, polystyrene, poly(vinyl acetate), poly(vinyl alcohol), poly(vinyl butyral), poly(vinyl chloride), poly(vinyl ether), poly(vinyl ketone), a vinyl chloride-vinyl acetate copolymer, a styrene-acrylic acid ester copolymer, a straight silicone resin including an organosiloxane bond and the modified products thereof, a fluorine resin, polyester, polycarbonate, a phenolic resin, and an epoxy resin.

The coat resin and the matrix resin may optionally include additives such as conductive particles.

Examples of the conductive particles include particles of metals such as gold, silver, and copper; and particles of carbon black, titanium oxide, zinc oxide, tin oxide, barium sulfate, aluminium borate, and potassium titanate.

The surfaces of the cores can be coated with a coat resin by, for example, using a coating-layer forming solution prepared by dissolving the coat resin and, as needed, various types of additives in a suitable solvent. The type of the solvent is not particularly limited and may be selected with consideration of the coat resin used, ease of applying the coating-layer forming solution, and the like.

Specific examples of a method for coating the surfaces of the cores with the coat resin include an immersion method in which the cores are immersed in the coating-layer forming solution; a spray method in which the coating-layer forming solution is sprayed onto the surfaces of the cores; a fluidized-bed method in which the coating-layer forming solution is sprayed onto the surfaces of the cores while the cores are floated using flowing air; and a kneader-coater method in which the cores of the carrier are mixed with the coating-layer forming solution in a kneader coater and subsequently the solvent is removed.

The mixing ratio (i.e., mass ratio) of the toner to the carrier in the two-component developer is preferably toner: carrier=1:100 to 30:100 and is more preferably 3:100 to 20:100.

Image Forming Apparatus and Image Forming Method

The image forming apparatus and the image forming method according to an exemplary embodiment are described below.

The image forming apparatus according to the exemplary embodiment includes an image carrier; a charging unit that charges the surface of the image carrier; an electrostatic-image forming unit that forms an electrostatic image on the surface of the image carrier charged; a developing unit that includes an electrostatic-image developer and develops the electrostatic image formed on the surface of the image carrier using the electrostatic-image developer to form a toner image; a transfer unit that transfers the toner image formed on the surface of the image carrier onto the surface of a recording medium; and a fixing unit that fixes the toner image onto the surface of the recording medium. The electrostatic-image developer according to the above-described exemplary embodiment is used as an electrostatic-image developer.

The image forming apparatus according to the exemplary embodiment employs an image forming method (image forming method according to the exemplary embodiment) including charging the surface of the image carrier; forming an electrostatic image on the surface of the charged image carrier; developing the electrostatic image formed on the surface of the image carrier using the electrostatic-image developer according to the above-described exemplary embodiment to form a toner image; transferring the toner image formed on the surface of the image carrier onto the surface of a recording medium; and fixing the toner image onto the surface of the recording medium.

The image forming apparatus according to the exemplary embodiment may be any image forming apparatus known in the related art, such as a direct-transfer-type image forming apparatus in which a toner image formed on the surface of the image carrier is directly transferred to a recording medium; an intermediate-transfer-type image forming apparatus in which a toner image formed on the surface of the image carrier is transferred onto the surface of the intermediate transfer body in the first transfer step and the toner image transferred on the surface of the intermediate transfer body is again transferred onto the surface of a recording medium in the second transfer step; an image forming apparatus including a cleaning unit that cleans the surface of the image carrier subsequent to transfer of the toner image before the image carrier is again charged; and an image forming apparatus including a static-eliminating unit that eliminates static by irradiating, after the toner image has been transferred, the surface of the image carrier to be again charged with static-eliminating light.

The intermediate-transfer-type image forming apparatus may include a transfer unit constituted by, for example, an intermediate transfer body to which a toner image is transferred, a first transfer subunit that transfers a toner image formed on the surface of the image carrier onto the surface of the intermediate transfer body in the first transfer step, and a second transfer subunit that transfers the toner image transferred on the surface of the intermediate transfer body onto the surface of a recording medium in the second transfer step.

In the image forming apparatus according to the exemplary embodiment, for example, a portion including the developing unit may have a cartridge structure (i.e., process cartridge) detachably attached to the image forming apparatus. An example of the process cartridge is a process cartridge including a developing unit including the electrostatic-image developer according to the above-described exemplary embodiment.

An example of the image forming apparatus according to an exemplary embodiment is described below, but the image forming apparatus is not limited to this. Only the components shown in drawings are described; others are omitted.

FIG. 1 schematically illustrates an example of the image forming apparatus according to the exemplary embodiment. The image-forming apparatus according to the exemplary embodiment has a tandem structure including plural photosensitive members serving as image-holding members, that is, plural image-forming units.

In the following description, an example case where a white toner is used as the toner according to the exemplary embodiment is described.

The image-forming apparatus according to the exemplary embodiment includes four image-forming units 50Y, 50M, 50C, and 50K that form yellow, magenta, cyan, and black toner images, respectively, and an image-forming unit 50W that forms a white toner image, which are arranged in parallel (i.e., in tandem) at certain intervals as illustrated in FIG. 1. The above image-forming units are arranged in the order of image-forming units 50Y, 50M, 50C, 50K, and 50W in the direction in which the intermediate transfer belt 33 rotates.

Since the image-forming units 50Y, 50M, 50C, 50K, and 50W have the same structure except for the color of the toner included in each developer, the following description is made with reference to, as a representative, the image-forming unit 50Y that forms a yellow image. Same members are labeled with the same reference numeral as the reference numeral of the image-forming unit 50Y except that magenta (M), cyan (C), black (K), and white (W) is used instead of yellow (Y) and the description of the image-forming units 50M, 50C, 50K, and 50W are omitted. In this exemplary embodiment, the toner according to the exemplary embodiment is used as a toner (white toner) included in a developer included in the image-forming unit 50W.

The yellow image-forming unit 50Y includes a photosensitive member 11Y serving as an image-holding member. The photosensitive member 11Y is rotated by a driving unit (not illustrated) in the direction shown by the arrow A at a predetermined processing speed. An example of the photosensitive member 11Y is an organic photosensitive member having a sensitivity in the infrared region.

A charging roller (i.e., a charging unit) 18Y is disposed above the photosensitive member 11Y. Upon a predetermined voltage being applied from a power source (not illustrated) to the charging roller 18Y, the surface of the photosensitive member 11Y is charged to a predetermined potential.

In the periphery of the photosensitive member 11Y, an exposure device (i.e., an electrostatic-image-forming unit) 19Y is disposed downstream of the charging roller 18Y in the direction in which the photosensitive member 11Y rotates. The exposure device 19Y irradiates the surface of the photosensitive member 11Y with light to form an electrostatic image thereon. Although an LED array, which enables size reduction, is used in the exemplary embodiment as an exposure device 19Y because of spatial limitations, the exposure device is not limited to this; another electrostatic-image-forming unit that emits a laser beam or the like may also be used.

In the periphery of the photosensitive member 11Y, a developing device (i.e., a developing unit) 20Y is disposed downstream of the exposure device 19Y in the direction in which the photosensitive member 11Y rotates. The developing device 20Y includes a developer-holding member that holds a yellow developer. The electrostatic image formed on the surface of the photosensitive member 11Y is rendered with the yellow toner to form a toner image on the surface of the photosensitive member 11Y.

An intermediate transfer belt (i.e., a first transfer unit) 33 is disposed below the photosensitive member 11Y so as to come into contact with the lower portions of the photosensitive members 11Y, 11M, 11C, 11K, and 11W. The toner image formed on the surface of the photosensitive member 11Y is first-transferred to the intermediate transfer belt 33. The intermediate transfer belt 33 is pressed by a first transfer roller 17Y against the surface of the photosensitive member 11Y. The intermediate transfer belt 33 is stretched by a driving roller 12, a supporting roller 13, and a bias roller 14 and rotated in the direction of the arrow B at a speed equal to the processing speed of the photosensitive member 11Y. After the yellow toner image has been first-transferred onto the surface of the intermediate transfer belt 33, magenta, cyan, black, and white toner images are sequentially first-transferred and stacked on top of one another.

In the periphery of the photosensitive member 11Y, a cleaning device 15Y is disposed downstream of the first transfer roller 17Y in the direction in which the photosensitive member 11Y rotates (i.e., the direction of the arrow A). The cleaning device 15Y is used for cleaning toner particles that remain on the surface of the photosensitive member 11Y and retransferred toner particles. The cleaning device 15Y includes a cleaning blade that is brought into pressure contact with the surface of the photosensitive member 11Y with the edge of the cleaning blade being oriented in a direction opposite to the direction of the rotation of the photosensitive member 11Y.

The bias roller 14, with which the intermediate transfer belt 33 is stretched, is in pressure contact with a second transfer roller (i.e., a second transfer unit) 34 with the intermediate transfer belt 33 interposed therebetween. The toner images, which have been first-transferred and stacked on the surface of the intermediate transfer belt 33, are electrostatically transferred onto the surface of a recording paper (i.e., a recording medium) P fed from a paper cassette (not illustrated) at the position at which the bias roller 14 and the second transfer roller 34 come into pressure contact with each other. Since the white toner image is at the top (i.e., the topmost layer) of the toner images that have been transferred and stacked on the intermediate transfer belt 33, the white toner image is at the bottom (i.e., the undermost layer) of the toner images transferred on the surface of the recording paper P.

A fixing device (i.e., a fixing unit) 35 is disposed downstream of the second transfer roller 34. The fixing device 35 is used for fixing the toner images that have been multiple-transferred on the recording paper P onto the surface of the recording paper P by heat and pressure to form a permanent image.

Examples of the fixing device 35 include a fixing belt having a belt-like shape which includes a low-surface-energy material deposited on the surface thereof, such as a fluororesin or a silicone resin, and a cylindrical fixing roller including a low-surface-energy material deposited on the surface thereof, such as a fluororesin or a silicone resin.

The actions of the image-forming units 50Y, 50M, 50C, 50K, and 50W, which form yellow, magenta, cyan, black, and white images, respectively, are described below. Since the actions of the image-forming units 50Y, 50M, 50C, 50K, and 50W are the same as one another, the action of the yellow image-forming unit 50Y is described below as a representative.

In the yellow developing unit 50Y, the photosensitive member 11Y is rotated in the direction of the arrow A at a predetermined processing speed. The charging roller 18Y negatively charges the surface of the photosensitive member 11Y to a predetermined potential. The charged surface of the photosensitive member 11Y is then exposed to light emitted by the exposure device 19Y to form an electrostatic image based on image information. Subsequently, reversal development is performed with a toner negatively charged by the developing device 20Y. As a result, the electrostatic image formed on the surface of the photosensitive member 11Y is made visible on the surface of the photosensitive member 11Y to form a toner image. The toner image formed on the surface of the photosensitive member 11Y is first-transferred onto the surface of the intermediate transfer belt 33 with the first transfer roller 17Y. Subsequent to the first transfer, a transfer-residual component, such as toner particles, that remains on the surface of the photosensitive member 11Y is scraped off with the cleaning blade of the cleaning device 15Y. Thus, the photosensitive member 11Y is cleaned in preparation for the next image-forming process.

The above-described action is performed in each of the image-forming units 50Y, 50M, 50C, 50K, and 50W, and visible toner images formed on the surfaces of the photosensitive members 11Y, 11M, 11C, 11K, and 11W are sequentially multiple-transferred onto the surface of the intermediate transfer belt 33. In a color-mode, yellow, magenta, cyan, black, and white toner images are multiple transferred in the order of yellow, magenta, cyan, black, and white. In a two-color or three-color mode, toner images of the selected colors are single- or multiple-transferred in this order. The toner images that have been single- or multiple-transferred on the surface of the intermediate transfer belt 33 are second-transferred with the second transfer roller 34 onto the surface of a recording paper P fed from a paper cassette (not illustrated) and subsequently fixed thereto with the fixing device 35 by heat and pressure. The toner that remains on the surface of the intermediate transfer belt 33 subsequent to the second transfer is removed with a belt cleaner 16 including a cleaning blade for the intermediate transfer belt 33.

Toner Cartridge

The toner cartridge according to an exemplary embodiment is described below.

The toner cartridge according to the exemplary embodiment includes the toner according to the exemplary embodiment and is detachably attachable to an image-forming apparatus. The toner cartridge includes a toner that is to be supplied to a developing unit included in an image-forming apparatus.

In FIG. 1, the toner cartridges 40Y, 40M, 40C, 40K, and 40W include yellow, magenta, cyan, black, and white toners and are each connected to a developing device associated with the color with a toner-feeding pipe (not illustrated). The toner cartridges 40Y, 40M, 40C, 40K, and 40W are detachably attachable to an image-forming apparatus and replaced when the amounts of toners contained in the toner cartridges are small.

Process Cartridge

The process cartridge according to an exemplary embodiment is described below.

The process cartridge according to the exemplary embodiment includes a developing unit that includes the electrostatic-image developer according to the above-described exemplary embodiment and develops an electrostatic image formed on the surface of an image carrier using the electrostatic-image developer to form a toner image. The process cartridge according to the exemplary embodiment is detachably attachable to an image forming apparatus.

The structure of the process cartridge according to the exemplary embodiment is not limited to the above-described one. The process cartridge according to the exemplary embodiment may further include, in addition to the developing unit, at least one unit selected from an image carrier, a charging unit, an electrostatic-image forming unit, a transfer unit, and the like as needed.

An example of the process cartridge according to the exemplary embodiment is described below, but the process cartridge is not limited thereto. Only components illustrated in FIG. 2 are described; others are omitted.

Figure 2:
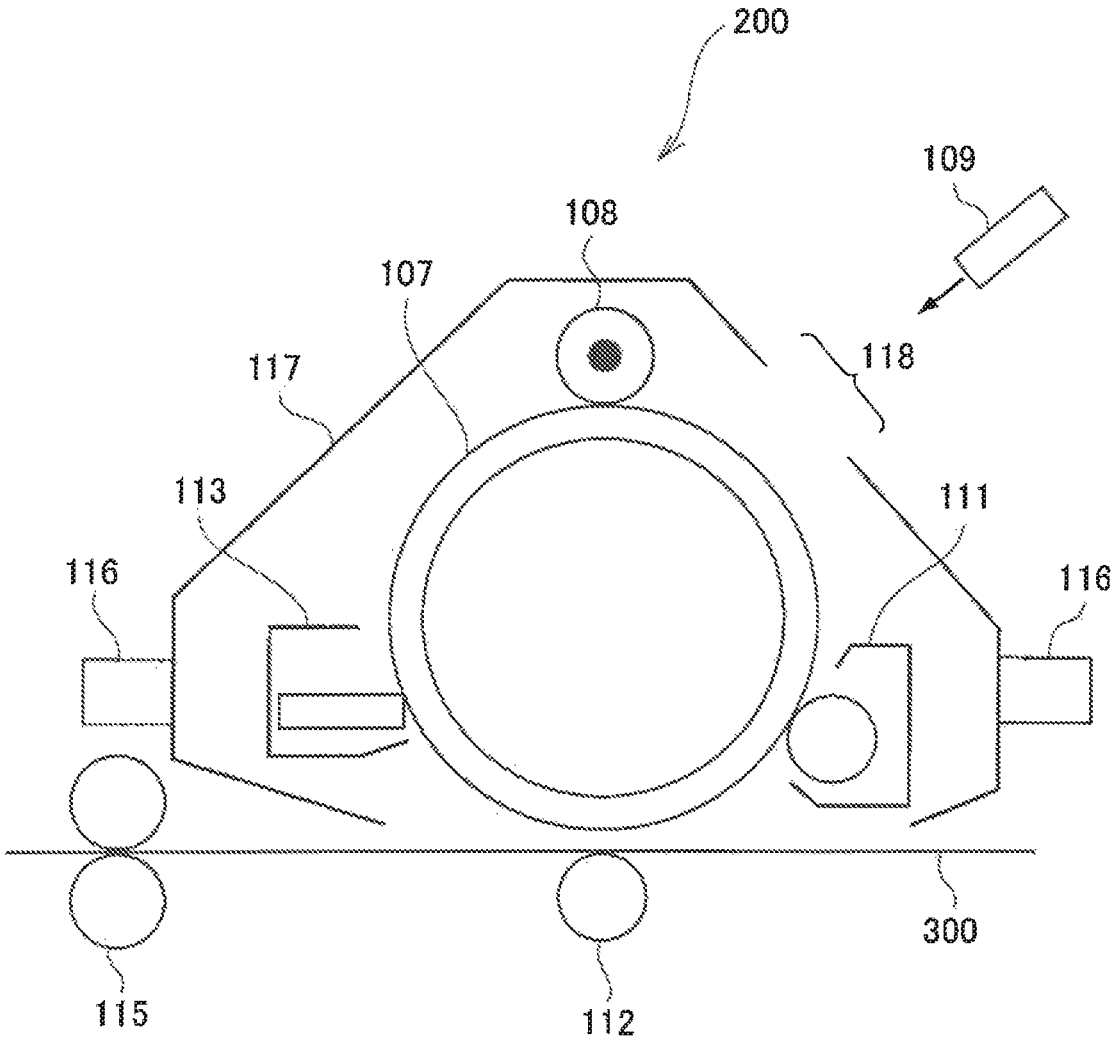
FIG. 2 is a diagram schematically illustrating an example of a process cartridge according to an exemplary embodiment.

FIG. 2 schematically illustrates the process cartridge according to the exemplary embodiment.

A process cartridge 200 illustrated in FIG. 2 includes, for example, a photosensitive member 107 (example of the image carrier), a charging roller 108 (example of the charging unit) disposed on the periphery of the photosensitive member 107, a developing device 111 (example of the developing unit), and a photosensitive-member-cleaning device 113 (example of the cleaning unit), which are combined into one unit using a housing 117 to form a cartridge. The housing 117 has an aperture 118 for exposure. A mounting rail 116 is disposed on the housing 117.

In FIG. 2, Reference numeral 109 denotes an exposure device (example of the electrostatic-image forming unit), Reference numeral 112 denotes a transfer device (example of the transfer unit), Reference numeral 115 denotes a fixing device (example of the fixing unit), and the Reference numeral 300 denotes recording paper (example of the recording medium).

EXAMPLES

The above-described embodiments are described below more specifically with reference to Examples and Comparative examples. The above-described embodiments are not limited by Examples below. Hereinafter, all "part" and "%" are on a mass basis unless otherwise specified.

Preparation of Titanium White Pigment Dispersion

Titanium oxide "CR-60-2" produced by ISHIHARA SANGYO KAISHA, LTD.: 100 parts

Nonionic surfactant "Nonipol 400" produced by Sanyo Chemical Industries, Ltd.: 10 parts Ion-exchange water: 400 parts The above components are mixed together, and the resulting mixture is stirred for 30 minutes with a homogenizer "ULTRA-TURRAX T50" produced by IKA. The mixture is then subjected to a dispersion treatment for one hour with a high-pressure impact disperser "Ultimaizer HJP30006" produced by SUGINO MACHINE LIMITED CO., LTD. Hereby, a titanium white pigment dispersion (solid content concentration: 20%) including titanium white pigment particles (volume-average size: 210 nm) dispersed therein is prepared.

Preparation of Metal Pigment Dispersion

Aluminum pigment "2173EA" produced by Showa Aluminum Powder K.K.: 100 parts

Anionic surfactant "Neogen R" produced by DKS Co. Ltd.: 1.5 parts

Ion-exchange water: 400 parts

After the solvent has been removed from the paste of the aluminum pigment, the pigment is mechanically pulverized with a "STARMILL LMZ" produced by Ashizawa Finetech Ltd. Metal pigment particles having a size of 8 μm or more and 10 μm or less are taken. The metal pigment particles are mixed with the surfactant and the ion-exchange water, and the resulting mixture is dispersed for about one hour with an emulsification disperser "CAVITRON CR1010" produced by Pacific Machinery & Engineering Co., Ltd. Hereby, a metal pigment dispersion (solid content concentration: 20%) including metal pigment particles (i.e., aluminum pigment particles) dispersed therein is prepared. The volume-average size of the metal pigment particles is 9.0 μm.

Preparation of Lead White Pigment Dispersion

Basic lead carbonate produced by Wako Pure Chemicals Industries, Ltd.: 100 parts Nonionic surfactant "Nonipol 400" produced by Sanyo Chemical Industries, Ltd.: 10 parts Ion-exchange water: 400 parts The above components are mixed together, and the resulting mixture is stirred for 30 minutes with a homogenizer "ULTRA-TURRAX T50" produced by IKA. The mixture is then subjected to a dispersion treatment for one hour with a high-pressure impact disperser "Ultimaizer HJP30006" produced by SUGINO MACHINE LIMITED CO., LTD. Hereby, a lead white pigment dispersion (solid content concentration: 20%) including lead white pigment particles (volume-average size: 280 nm) dispersed therein is prepared.

Preparation of Cobalt Blue Pigment Dispersion

Cobalt blue "Pigment Blue 28" produced by ASAHI KASEI KOGYO CO., LTD.: 100 parts Nonionic surfactant "Nonipol 400" produced by Sanyo Chemical Industries, Ltd.: 10 parts Ion-exchange water: 400 parts The above components are mixed together, and the resulting mixture is stirred for 30 minutes with a homogenizer "ULTRA-TURRAX T50" produced by IKA. The mixture is then subjected to a dispersion treatment for one hour with a high-pressure impact disperser "Ultimaizer HJP30006" produced by SUGINO MACHINE LIMITED CO., LTD. Hereby, a cobalt blue pigment dispersion (solid content concentration: 20%) including inorganic blue pigment particles (volume-average size: 250 nm) dispersed therein is prepared.

Preparation of Release Agent Dispersion 1

Paraffin wax "Paraffin Wax 150" (melting temperature: 66° C.) produced by NIPPON SEIRO CO., LTD.: 50 parts Anionic surfactant "Neogen RK" produced by DKS Co. Ltd.: 1.0 parts Sodium chloride produced by Wako Pure Chemicals Industries, Ltd.: 5 parts Ion-exchange water: 200 parts The above components are mixed together, and the resulting mixture is heated to 95° C. The mixture is subsequently dispersed with a homogenizer "ULTRA-TURRAX T50" produced by IKA. The mixture is further subjected to a dispersion treatment for 360 minutes with a "Manton-Gaulin high-pressure homogenizer" produced by Gaulin. Hereby, a release agent dispersion 1 (solid content concentration: 20%) including release agent particles (volume-average size: 0.23 μm) dispersed therein is prepared.

Preparation of Release Agent Dispersion 2

A release agent dispersion 2 (solid content concentration: 20%) including release agent particles (volume-average size: 0.24 μm) dispersed therein is prepared as in the preparation of the release agent dispersion 1, except that a paraffin wax "HNP9" (melting temperature: 75° C.) produced by NIPPON SEIRO CO., LTD. is used instead of "Paraffin Wax 150" produced by NIPPON SEIRO CO., LTD.

Preparation of Release Agent Dispersion 3

A release agent dispersion 3 (solid content concentration: 20%) including release agent particles (volume-average size: 0.23 μm) dispersed therein is prepared as in the preparation of the release agent dispersion 1, except that a Fischer-Tropsch wax "FNP0090" (melting temperature: 90° C.) produced by NIPPON SEIRO CO., LTD. is used instead of "Paraffin Wax 150" produced by NIPPON SEIRO CO., LTD.

Preparation of Release Agent Dispersion 4

A release agent dispersion 4 (solid content concentration: 20%) including release agent particles (volume-average size: 0.23 μm) dispersed therein is prepared as in the preparation of the release agent dispersion 1, except that a Fischer-Tropsch wax "FT-105" (melting temperature: 104° C.) produced by NIPPON SEIRO CO., LTD. is used instead of "Paraffin Wax 150" produced by NIPPON SEIRO CO., LTD.

Preparation of Release Agent Dispersion 5

A release agent dispersion 5 (solid content concentration: 20%) including release agent particles (volume-average size: 0.24 μm) dispersed therein is prepared as in the preparation of the release agent dispersion 1, except that a Fischer-Tropsch wax "FT-115" (melting temperature: 113° C.) produced by NIPPON SEIRO CO., LTD. is used instead of "Paraffin Wax 150" produced by NIPPON SEIRO CO., LTD.

Preparation of Release Agent Dispersion 6

A release agent dispersion 6 (solid content concentration: 20%) including release agent particles (volume-average size: 0.24 μm) dispersed therein is prepared as in the preparation of the release agent dispersion 1, except that an amide wax "DIAMID Y" (melting temperature: 87° C.) produced by Nippon Kasei Chemical Company Limited. is used instead of "Paraffin Wax 150" produced by NIPPON SEIRO CO., LTD.

Preparation of Release Agent Dispersion 7

A release agent dispersion 7 (solid content concentration: 20%) including release agent particles (volume-average size: 0.23 μu) dispersed therein is prepared as in the preparation of the release agent dispersion 1, except that a polyethylene wax "PW600" (melting temperature: 92° C.) produced by TOYO ADL CORPORATION is used instead of "Paraffin Wax 150" produced by NIPPON SEIRO CO., LTD.

Preparation of Release Agent Dispersion 8

A release agent dispersion 8 (solid content concentration: 20%) including release agent particles (volume-average size: 0.23 μm) dispersed therein is prepared as in the preparation of the release agent dispersion 1, except that an ester wax "WEP-5" (melting temperature: 85° C.) produced by NOF CORPORATION is used instead of "Paraffin Wax 150" produced by NIPPON SEIRO CO., LTD.

Synthesis of Amorphous Polyester Resin

Bisphenol A ethylene oxide 2.2-mol adduct: 40 mol %
Bisphenol A propylene oxide 2.2-mol adduct: 60 mol %
Terephthalic acid: 47 mol %
Fumaric acid: 40 mol %
Dodecenylsuccinic anhydride: 15 mol %
Trimellitic anhydride: 3 mol %

The above monomer components other than fumaric acid and trimellitic anhydride are charged into a reaction container equipped with a stirrer, a thermometer, a condenser, and a nitrogen-gas-introduction pipe. Tin dioctanoate is further charged into the reaction container such that the amount of tin dioctanoate is 0.25 parts relative to 100 parts of the total amount of the above monomer components. The resulting mixture is reacted at 235° C. for 6 hours under a stream of nitrogen gas. Subsequently, the temperature is reduced to 200° C., and the fumaric acid and trimellitic anhydride are charged into the reaction container. The resulting mixture is reacted for one hour. Subsequently, the temperature is increased to 220° C. over 4 hours. Polymerization is performed under a pressure of 10 kPa until a desired molecular weight is achieved. Hereby, a light-yellow, transparent amorphous polyester resin is prepared.

The glass-transition temperature Tg of the amorphous polyester resin determined by DSC is 59° C. The weight-average molecular weight Mw and the number-average molecular weight Mn of the amorphous polyester resin determined by GPC are 25,000 and 7,000, respectively. The softening temperature of the amorphous polyester resin determined with a flow tester is 107° C. The acid value AV of the amorphous polyester resin is 13 mgKOH/g.

Preparation of Amorphous Polyester Resin Dispersion

While a jacketed 3-liter reaction vessel "BJ-30N" produced by TOKYO RIKAKIKAI CO, LTD. equipped with a condenser, a thermometer, a water dropper, and an anchor paddle is maintained at 40° C. in a water-circulation thermostat, a mixed solvent of 160 parts of ethyl acetate and 100 parts of isopropyl alcohol is added to the reaction vessel. To the reaction vessel, 300 parts of the amorphous polyester resin is added. The resulting mixture is stirred with a three-one motor at 150 rpm to form a solution. Hereby, an oil phase is formed. To the stirred oil phase, 14 parts of a 10%-aqueous ammonia solution is added dropwise over 5 minutes. After the resulting mixture has been stirred for 10 minutes, 900 parts of ion-exchange water is added dropwise to the mixture at a rate of 7 part/min in order to perform phase inversion. Hereby, an emulsion is formed.

Subsequently, 800 parts of the emulsion and 700 parts of ion-exchange water are immediately charged into a 2-liter eggplant flask, which is then connected to an evaporator produced by TOKYO RIKAKIKAI CO, LTD. equipped with a vacuum-control unit with a trap ball interposed therebetween. While the eggplant flask is rotated, it is heated in a hot-water bath maintained at 60° C. The pressure is reduced to 7 kPa to remove the solvent, with due attention paid to avoiding bumping. When the amount of solvent recovered reaches 1,100 parts, the pressure is increased to normal pressure and the eggplant flask is cooled with water. Hereby, a dispersion is formed. The dispersion does not have the odor of the solvent. The volume-average size of the resin particles included in the dispersion is 130 nm.

Ion-exchange water is then added to the dispersion such that the solid content concentration in the dispersion is 20%. The above dispersion is used as an amorphous polyester resin dispersion.

Synthesis of Crystalline Polyester Resin 1,10-Dodecanedioic acid: 50 mol %
1,9-Nonanediol: 50 mol %

The above monomer components are charged into a reaction container equipped with a stirrer, a thermometer, a condenser, and a nitrogen-gas-introduction pipe. After the reaction container has been purged with a dry nitrogen gas, titanium tetrabutoxide (i.e., a reagent) is charged into the reaction container such that the amount of reagent is 0.25 parts relative to 100 parts of the total amount of the monomer components. The resulting mixture is reacted at 170° C. for 3 hours under a stream of nitrogen gas. Subsequently, the temperature is increased to 210° C. over 1 hour, and the pressure inside the reaction container is reduced to 3 kPa. The mixture is reacted for 13 hours while being stirred under the reduced pressure. Hereby, a crystalline polyester resin is prepared.

The melting temperature of the crystalline polyester resin determined by DSC is 73.6° C. The weight-average molecular weight Mw and the number-average molecular weight Mn of the crystalline polyester resin determined by GPC are 25,000 and 10,500, respectively. The acid value AV of the crystalline polyester resin is 10.1 mgKOH/g.

Preparation of Crystalline Polyester Resin Dispersion

Into a jacketed 3-liter reaction vessel "BJ-30N" produced by TOKYO RIKAKIKAI CO, LTD. equipped with a condenser, a thermometer, a water dropper, and an anchor paddle, 300 parts of the crystalline polyester resin, 160 parts of methyl ethyl ketone used as a solvent, and 100 parts of isopropyl alcohol used as a solvent are charged. While the temperature is maintained at 70° C. in a water-circulation thermostat, the resin is dissolved in the solvents while the resulting mixture is stirred at 100 rpm.

After the number of rotation of the stirrer has been changed to 150 rpm and the temperature of the water-circulation thermostat has been set to 66° C., 17 parts of 10%-ammonia water used as a reagent is charged into the reaction vessel over 10 minutes. Then, 900 parts of ion-exchange water maintained at 66° C. is added dropwise to the resulting mixture at a rate of 7 part/min in order to perform phase inversion. Hereby, an emulsion is formed.

Subsequently, 800 parts of the emulsion and 700 parts of ion-exchange water are immediately charged into a 2-liter eggplant flask, which is then connected to an evaporator produced by TOKYO RIKAKIKAI CO, LTD. equipped with a vacuum-control unit with a trap ball interposed therebetween. While the eggplant flask is rotated, it is heated in a hot-water bath maintained at 60° C. The pressure is reduced to 7 kPa to remove the solvent, with due attention paid to avoiding bumping. When the amount of solvent recovered reaches 1,100 parts, the pressure is increased to normal pressure and the eggplant flask is cooled with water. Hereby, a dispersion is formed. The dispersion does not have the odor of the solvent. The volume-average size of the resin particles included in the dispersion is 130 nm. Ion-exchange water is then added to the dispersion such that the solid content concentration in the dispersion is 20%. The above dispersion is used as a crystalline polyester resin dispersion.

Preparation of Crystalline Styrene Acrylic Resin Dispersion

Styrene: 100 parts
Vinyl stearate: 208 parts
n-Butyl acrylate: 100 parts
Acrylic acid: 4 parts
Dodecanethiol: 6 parts
Propanediol diacrylate: 1.5 parts The above components are mixed together to form a solution. The solution is added to an aqueous solution prepared by dissolving 4 parts of an anionic surfactant "Neogen SC" produced by DKS Co. Ltd. in 550 parts of ion-exchange water, and emulsification is performed in the flask. While the resulting emulsion is stirred for 10 minutes, an aqueous solution prepared by dissolving 6 parts of ammonium persulfate in 50 parts of ion-exchange water is added to the emulsion. After the flask has been purged with nitrogen, the contents of the flask are heated to 75C in an oil bath while being stirred. Under the above conditions, emulsion polymerization is continued for five hours. Hereby, a crystalline styrene acrylic resin dispersion (resin particle concentration: 40%) including resin particles (volume-average size: 190 nm, weight-average molecular weight Mw: 35,000) dispersed therein is prepared. The melting temperature of the crystalline styrene acrylic resin is 62° C.

Preparation of Amorphous Styrene Acrylic Resin Dispersion

Styrene: 308 parts
n-Butyl acrylate: 100 parts
Acrylic acid: 4 parts
Dodecanethiol: 6 parts
Propanediol diacrylate: 1.5 parts The above components are mixed together to form a solution. The solution is added to an aqueous solution prepared by dissolving 4 parts of an anionic surfactant "Neogen SC" produced by DKS Co. Ltd. in 550 parts of ion-exchange water, and emulsification is performed in the flask. While the resulting emulsion is stirred for 10 minutes, an aqueous solution prepared by dissolving 6 parts of ammonium persulfate in 50 parts of ion-exchange water is added to the emulsion. After the flask has been purged with nitrogen, the contents of the flask are heated to 75° C. in an oil bath while being stirred. Under the above conditions, emulsion polymerization is continued for five hours. Hereby, an amorphous styrene acrylic resin dispersion (resin particle concentration: 40%) including resin particles (volume-average size: 195 nm, weight-average molecular weight Mw: 34,000) dispersed therein is prepared. The glass-transition temperature of the amorphous styrene acrylic resin is 52° C.

Example 1

Preparation of Toner Particles

Amorphous polyester resin dispersion: 400 parts
Crystalline polyester resin dispersion: 100 parts
Titanium white pigment dispersion: 200 parts
Release agent dispersion 1: 70 parts
Anionic surfactant "TaycaPower" produced by TAYCA CORPORATION: 8 parts The above materials are charged into a round-bottom flask made of stainless steel. To the resulting mixture, 0.1 N-nitric acid is added in order to adjust the pH of the mixture to be 2.5. Subsequently, 3 parts of an aqueous nitric acid solution containing polyaluminum chloride at a concentration of 10% is added to the mixture. After the mixture has been dispersed at 8° C. for 5 minutes with a homogenizer "ULTRA-TURRAX T50" produced by IKA, it is heated to 45° C. in an oil bath and then held for 30 minutes. Subsequently, 230 parts of the amorphous polyester resin dispersion is gradually further added to the mixture. After the mixture has been held for 1 hour, a 0.1 N-aqueous sodium hydroxide solution is added to the mixture in order to adjust the pH of the mixture to be 8.5. While being stirred, the mixture is then heated to 63° C., which is lower than the melting temperature of the release agent by 3° C., and subsequently held for 10 hours. The mixture is subsequently cooled to 20° C. at a rate of 20° C./min, filtered, sufficiently washed with ion-exchange water, and then dried. Hereby, toner particles (1) having a volume-average size of 7.5 m are prepared.

Preparation of Toner

The toner particles (1) (100 parts) are mixed with 0.7 parts of silica particles treated with dimethyl silicone oil, "RY200", produced by NIPPON AEROSIL CO., LTD. in a Henschel mixer. Hereby, a toner (1) is prepared.

Preparation of Developer

Ferrite particles (average size: 50 μm): 100 parts
Toluene: 14 parts
Styrene-methyl methacrylate copolymer (copolymerization ratio: 15/85): 3 parts
Carbon black: 0.2 parts The above components other than the ferrite particles are dispersed with a sand mill to form a dispersion. The dispersion and the ferrite particles are charged into a vacuum-degassing kneader. While the resulting mixture is stirred, the pressure is reduced and drying is performed. Hereby, a carrier is prepared.

With 100 parts of the carrier, 8 parts of the toner (1) is mixed. Hereby, a developer (1) is prepared.

Example 2

Preparation of Toner Particles

Amorphous polyester resin dispersion: 400 parts
Crystalline polyester resin dispersion: 100 parts
Titanium white pigment dispersion: 200 parts
Release agent dispersion 2: 70 parts
Anionic surfactant "TaycaPower" produced by TAYCA CORPORATION: 8 parts The above materials are charged into a round-bottom flask made of stainless steel. To the resulting mixture, 0.1 N-nitric acid is added in order to adjust the pH of the mixture to be 2.5. Subsequently, 3 parts of an aqueous nitric acid solution containing polyaluminum chloride at a concentration of 10% is added to the mixture. After the mixture has been dispersed at 5° C. for 5 minutes with a homogenizer "ULTRA-TURRAX T50" produced by IKA, it is heated to 45° C. in an oil bath and then held for 30 minutes. Subsequently, 230 parts of the amorphous polyester resin dispersion is gradually further added to the mixture. After the mixture has been held for 1 hour, a 0.1 N-aqueous sodium hydroxide solution is added to the mixture in order to adjust the pH of the mixture to be 8.5. While being stirred, the mixture is then heated to 65° C., which is lower than the melting temperature of the release agent by 10° C., and subsequently held for 10 hours. The mixture is subsequently cooled to 20° C. at a rate of 20° C./min, filtered, sufficiently washed with ion-exchange water, and then dried. Hereby, toner particles (2) having a volume-average size of 7.5 μm are prepared.

Preparation of Toner and Developer

A toner (2) and a developer (2) are prepared as in Example 1, except that the toner particles (2) are used instead of the toner particles (1).

Example 3

Preparation of Toner Particles

Amorphous polyester resin dispersion: 400 parts
Crystalline polyester resin dispersion: 100 parts
Titanium white pigment dispersion: 200 parts
Release agent dispersion 3: 70 parts
Anionic surfactant "TaycaPower" produced by TAYCA CORPORATION: 8 parts The above materials are charged into a round-bottom flask made of stainless steel. To the resulting mixture, 0.1 N-nitric acid is added in order to adjust the pH of the mixture to be 2.5. Subsequently, 3 parts of an aqueous nitric acid solution containing polyaluminum chloride at a concentration of 10% is added to the mixture. After the mixture has been dispersed at 5° C. for 5 minutes with a homogenizer "ULTRA-TURRAX T50" produced by IKA, it is heated to 45° C. in an oil bath and then held for 30 minutes. Subsequently, 230 parts of the amorphous polyester resin dispersion is gradually further added to the mixture. After the mixture has been held for 1 hour, a 0.1 N-aqueous sodium hydroxide solution is added to the mixture in order to adjust the pH of the mixture to be 8.5. While being stirred, the mixture is then heated to 70° C., which is lower than the melting temperature of the release agent by 20° C., and subsequently held for 8 hours. The mixture is subsequently cooled to 20° C. at a rate of 20° C./min, filtered, sufficiently washed with ion-exchange water, and then dried. Hereby, toner particles (3) having a volume-average size of 7.5 μm are prepared.

Preparation of Toner and Developer

A toner (3) and a developer (3) are prepared as in Example 1, except that the toner particles (3) are used instead of the toner particles (1).

Example 4

Preparation of Toner Particles

Amorphous polyester resin dispersion: 400 parts
Crystalline polyester resin dispersion: 100 parts
Titanium white pigment dispersion: 200 parts
Release agent dispersion 4: 70 parts
Anionic surfactant "TaycaPower" produced by TAYCA CORPORATION: 8 parts The above materials are charged into a round-bottom flask made of stainless steel. To the resulting mixture, 0.1 N-nitric acid is added in order to adjust the pH of the mixture to be 2.5. Subsequently, 3 parts of an aqueous nitric acid solution containing polyaluminum chloride at a concentration of 10% is added to the mixture. After the mixture has been dispersed at 5° C. for 5 minutes with a homogenizer "ULTRA-TURRAX T50" produced by IKA, it is heated to 45° C. in an oil bath and then held for 30 minutes. Subsequently, 230 parts of the amorphous polyester resin dispersion is gradually further added to the mixture. After the mixture has been held for 1 hour, a 0.1 N-aqueous sodium hydroxide solution is added to the mixture in order to adjust the pH of the mixture to be 8.5. While being stirred, the mixture is then heated to 84° C., which is lower than the melting temperature of the release agent by 20° C., and subsequently held for 5 hours. The mixture is subsequently cooled to 20° C. at a rate of 20° C./min, filtered, sufficiently washed with ion-exchange water, and then dried. Hereby, toner particles (4) having a volume-average size of 7.5 μm are prepared.

Preparation of Toner and Developer

A toner (4) and a developer (4) are prepared as in Example 1, except that the toner particles (4) are used instead of the toner particles (1).

Example 5

Preparation of Toner Particles

Amorphous polyester resin dispersion: 400 parts
Crystalline polyester resin dispersion: 100 parts
Titanium white pigment dispersion: 200 parts
Release agent dispersion 5: 70 parts
Anionic surfactant "TaycaPower" produced by TAYCA CORPORATION: 8 parts The above materials are charged into a round-bottom flask made of stainless steel. To the resulting mixture, 0.1 N-nitric acid is added in order to adjust the pH of the mixture to be 2.5. Subsequently, 3 parts of an aqueous nitric acid solution containing polyaluminum chloride at a concentration of 10% is added to the mixture. After the mixture has been dispersed at 5° C. for 5 minutes with a homogenizer "ULTRA-TURRAX T50" produced by IKA, it is heated to 45° C. in an oil bath and then held for 30 minutes. Subsequently, 230 parts of the amorphous polyester resin dispersion is gradually further added to the mixture. After the mixture has been held for 1 hour, a 0.1 N-aqueous sodium hydroxide solution is added to the mixture in order to adjust the pH of the mixture to be 8.5. While being stirred, the mixture is then heated to 93° C., which is lower than the melting temperature of the release agent by 20° C., and subsequently held for 3 hours. The mixture is subsequently cooled to 20° C. at a rate of 20° C./min, filtered, sufficiently washed with ion-exchange water, and then dried. Hereby, toner particles (5) having a volume-average size of 7.5 m are prepared.

Preparation of Toner and Developer

A toner (5) and a developer (5) are prepared as in Example 1, except that the toner particles (5) are used instead of the toner particles (1).

Example 6

Preparation of Toner Particles

Amorphous polyester resin dispersion: 400 parts
Crystalline polyester resin dispersion: 100 parts
Titanium white pigment dispersion: 200 parts
Release agent dispersion 4: 70 parts
Anionic surfactant "TaycaPower" produced by TAYCA CORPORATION: 8 parts The above materials are charged into a round-bottom flask made of stainless steel. To the resulting mixture, 0.1 N-nitric acid is added in order to adjust the pH of the mixture to be 2.8. Subsequently, 3 parts of an aqueous nitric acid solution containing polyaluminum chloride at a concentration of 10% is added to the mixture. After the mixture has been dispersed at 5° C. for 5 minutes with a homogenizer "ULTRA-TURRAX T50" produced by IKA, it is heated to 45° C. in an oil bath and then held for 30 minutes. Subsequently, 230 parts of the amorphous polyester resin dispersion is gradually further added to the mixture. After the mixture has been held for 1 hour, a 0.1 N-aqueous sodium hydroxide solution is added to the mixture in order to adjust the pH of the mixture to be 8.5. While being stirred, the mixture is then heated to 84° C., which is lower than the melting temperature of the release agent by 20° C., and subsequently held for 5 hours. The mixture is subsequently cooled to 20° C. at a rate of 20° C./min, filtered, sufficiently washed with ion-exchange water, and then dried. Hereby, toner particles (6) having a volume-average size of 7.5 μm are prepared.

Preparation of Toner and Developer

A toner (6) and a developer (6) are prepared as in Example 1, except that the toner particles (6) are used instead of the toner particles (1).

Example 7

Preparation of Toner Particles

Amorphous polyester resin dispersion: 400 parts
Crystalline polyester resin dispersion: 100 parts
Titanium white pigment dispersion: 200 parts
Release agent dispersion 4: 70 parts
Anionic surfactant "TaycaPower" produced by TAYCA CORPORATION: 8 parts The above materials are charged into a round-bottom flask made of stainless steel. To the resulting mixture, 0.1 N-nitric acid is added in order to adjust the pH of the mixture to be 2.1. Subsequently, 3 parts of an aqueous nitric acid solution containing polyaluminum chloride at a concentration of 10% is added to the mixture. After the mixture has been dispersed at 5° C. for 5 minutes with a homogenizer "ULTRA-TURRAX T50" produced by IKA, it is heated to 45° C. in an oil bath and then held for 30 minutes. Subsequently, 230 parts of the amorphous polyester resin dispersion is gradually further added to the mixture. After the mixture has been held for 1 hour, a 0.1 N-aqueous sodium hydroxide solution is added to the mixture in order to adjust the pH of the mixture to be 8.5. While being stirred, the mixture is then heated to 84° C., which is lower than the melting temperature of the release agent by 20° C., and subsequently held for 5 hours. The mixture is subsequently cooled to 20° C. at a rate of 20° C./min, filtered, sufficiently washed with ion-exchange water, and then dried. Hereby, toner particles (7) having a volume-average size of 7.5 m are prepared.

Preparation of Toner and Developer

A toner (7) and a developer (7) are prepared as in Example 1, except that the toner particles (7) are used instead of the toner particles (1).

Example 8

Preparation of Toner Particles

Amorphous polyester resin dispersion: 400 parts
Crystalline polyester resin dispersion: 100 parts
Titanium white pigment dispersion: 200 parts
Release agent dispersion 4: 70 parts
Anionic surfactant "TaycaPower" produced by TAYCA CORPORATION: 8 parts The above materials are charged into a round-bottom flask made of stainless steel. To the resulting mixture, 0.1 N-nitric acid is added in order to adjust the pH of the mixture to be 2.5. Subsequently, 3 parts of an aqueous nitric acid solution containing polyaluminum chloride at a concentration of 10% is added to the mixture. After the mixture has been dispersed at 5° C. for 5 minutes with a homogenizer "ULTRA-TURRAX T50" produced by IKA, it is heated to 45° C. in an oil bath and then held for 30 minutes. Subsequently, 230 parts of the amorphous polyester resin dispersion is gradually further added to the mixture. After the mixture has been held for 1 hour, a 0.1 N-aqueous sodium hydroxide solution is added to the mixture in order to adjust the pH of the mixture to be 8.5. While being stirred, the mixture is then heated to 78° C., which is lower than the melting temperature of the release agent by 26° C., and subsequently held for 5 hours. The mixture is subsequently cooled to 20° C. at a rate of 20° C./min, filtered, sufficiently washed with ion-exchange water, and then dried. Hereby, toner particles (8) having a volume-average size of 7.5 m are prepared.

Preparation of Toner and Developer

A toner (8) and a developer (8) are prepared as in Example 1, except that the toner particles (8) are used instead of the toner particles (1).

Example 9

Preparation of Toner Particles

Amorphous polyester resin dispersion: 400 parts
Crystalline polyester resin dispersion: 100 parts
Titanium white pigment dispersion: 200 parts
Release agent dispersion 4: 70 parts
Anionic surfactant "TaycaPower" produced by TAYCA CORPORATION: 8 parts The above materials are charged into a round-bottom flask made of stainless steel. To the resulting mixture, 0.1 N-nitric acid is added in order to adjust the pH of the mixture to be 2.5. Subsequently, 3 parts of an aqueous nitric acid solution containing polyaluminum chloride at a concentration of 10% is added to the mixture. After the mixture has been dispersed at 5° C. for 5 minutes with a homogenizer "ULTRA-TURRAX T50" produced by IKA, it is heated to 45° C. in an oil bath and then held for 30 minutes. Subsequently, 230 parts of the amorphous polyester resin dispersion is gradually further added to the mixture. After the mixture has been held for 1 hour, a 0.1 N-aqueous sodium hydroxide solution is added to the mixture in order to adjust the pH of the mixture to be 8.5. While being stirred, the mixture is then heated to 92° C., which is lower than the melting temperature of the release agent by 12° C., and subsequently held for 3 hours. The mixture is subsequently cooled to 20° C. at a rate of 20° C./min, filtered, sufficiently washed with ion-exchange water, and then dried. Hereby, toner particles (9) having a volume-average size of 7.5 μm are prepared.

Preparation of Toner and Developer

A toner (9) and a developer (9) are prepared as in Example 1, except that the toner particles (9) are used instead of the toner particles (1).

Example 10

Preparation of Toner Particles

Amorphous polyester resin dispersion: 400 parts
Crystalline polyester resin dispersion: 100 parts
Titanium white pigment dispersion: 200 parts
Release agent dispersion 4: 70 parts
Anionic surfactant "TaycaPower" produced by TAYCA CORPORATION: 8 parts The above materials are charged into a round-bottom flask made of stainless steel. To the resulting mixture, 0.1 N-nitric acid is added in order to adjust the pH of the mixture to be 2.5. Subsequently, 3 parts of an aqueous nitric acid solution containing polyaluminum chloride at a concentration of 10% is added to the mixture. After the mixture has been dispersed at 5° C. with a homogenizer "ULTRA-TURRAX T50" produced by IKA, it is heated to 45° C. in an oil bath and then held for 30 minutes. Subsequently, 230 parts of the amorphous polyester resin dispersion is gradually further added to the mixture. After the mixture has been held for 1 hour, a 0.1 N-aqueous sodium hydroxide solution is added to the mixture in order to adjust the pH of the mixture to be 8.5. While being stirred, the mixture is then heated to 88° C., which is lower than the melting temperature of the release agent by 16° C., and subsequently held for 4 hours. The mixture is subsequently cooled to 20° C. at a rate of 20°

C./min, filtered, sufficiently washed with ion-exchange water, and then dried. Hereby, toner particles (10) having a volume-average size of 7.5 μm are prepared.

Preparation of Toner and Developer

A toner (10) and a developer (10) are prepared as in Example 1, except that the toner particles (10) are used instead of the toner particles (1).

Example 11

Preparation of Toner Particles

Amorphous polyester resin dispersion: 400 parts
Crystalline polyester resin dispersion: 100 parts
Metal pigment dispersion: 200 parts
Release agent dispersion 4: 70 parts
Anionic surfactant "TaycaPower" produced by TAYCA CORPORATION: 8 parts The above materials are charged into a round-bottom flask made of stainless steel. To the resulting mixture, 0.1 N-nitric acid is added in order to adjust the pH of the mixture to be 2.5. Subsequently, 3 parts of an aqueous nitric acid solution containing polyaluminum chloride at a concentration of 10% is added to the mixture. After the mixture has been dispersed at 5° C. for 5 minutes with a homogenizer "ULTRA-TURRAX T50" produced by IKA, it is heated to 45° C. in an oil bath and then held for 30 minutes. Subsequently, 230 parts of the amorphous polyester resin dispersion is gradually further added to the mixture. After the mixture has been held for 1 hour, a 0.1 N-aqueous sodium hydroxide solution is added to the mixture in order to adjust the pH of the mixture to be 8.5. While being stirred, the mixture is then heated to 84° C., which is lower than the melting temperature of the release agent by 20° C., and subsequently held for 5 hours. The mixture is subsequently cooled to 20° C. at a rate of 20° C./min, filtered, sufficiently washed with ion-exchange water, and then dried. Hereby, toner particles (11) having a volume-average size of 12.0 m are prepared.

Preparation of Toner and Developer

A toner (11) and a developer (11) are prepared as in Example 1, except that the toner particles (11) are used instead of the toner particles (1).

Example 12

Preparation of Toner Particles

Amorphous polyester resin dispersion: 400 parts
Crystalline polyester resin dispersion: 100 parts
Lead white pigment dispersion: 200 parts
Release agent dispersion 4: 70 parts
Anionic surfactant "TaycaPower" produced by TAYCA CORPORATION: 8 parts The above materials are charged into a round-bottom flask made of stainless steel. To the resulting mixture, 0.1 N-nitric acid is added in order to adjust the pH of the mixture to be 2.5. Subsequently, 3 parts of an aqueous nitric acid solution containing polyaluminum chloride at a concentration of 10% is added to the mixture. After the mixture has been dispersed at 5° C. for 5 minutes with a homogenizer "ULTRA-TURRAX T50" produced by IKA, it is heated to 45° C. in an oil bath and then held for 30 minutes. Subsequently, 230 parts of the amorphous polyester resin dispersion is gradually further added to the mixture. After the mixture has been held for 1 hour, a 0.1 N-aqueous sodium hydroxide solution is added to the mixture in order to adjust the pH of the mixture to be 8.5. While being stirred, the mixture is then heated to 84° C., which is lower than the melting temperature of the release agent by 20° C., and subsequently held for 5 hours. The mixture is subsequently cooled to 20° C. at a rate of 20° C./min, filtered, sufficiently washed with ion-exchange water, and then dried. Hereby, toner particles (12) having a volume-average size of 7.5 μm are prepared.

Preparation of Toner and Developer

A toner (12) and a developer (12) are prepared as in Example 1, except that the toner particles (12) are used instead of the toner particles (1).

Example 13

Preparation of Toner Particles

Amorphous polyester resin dispersion: 400 parts
Crystalline polyester resin dispersion: 100 parts
Cobalt blue pigment dispersion: 200 parts
Release agent dispersion 4: 70 parts
Anionic surfactant "TaycaPower" produced by TAYCA CORPORATION: 8 parts The above materials are charged into a round-bottom flask made of stainless steel. To the resulting mixture, 0.1 N-nitric acid is added in order to adjust the pH of the mixture to be 2.5. Subsequently, 3 parts of an aqueous nitric acid solution containing polyaluminum chloride at a concentration of 10% is added to the mixture. After the mixture has been dispersed at 5° C. for 5 minutes with a homogenizer "ULTRA-TURRAX T50" produced by IKA, it is heated to 45° C. in an oil bath and then held for 30 minutes. Subsequently, 230 parts of the amorphous polyester resin dispersion is gradually further added to the mixture. After the mixture has been held for 1 hour, a 0.1 N-aqueous sodium hydroxide solution is added to the mixture in order to adjust the pH of the mixture to be 8.5. While being stirred, the mixture is then heated to 84° C., which is lower than the melting temperature of the release agent by 20° C., and subsequently held for 5 hours. The mixture is subsequently cooled to 20° C. at a rate of 20° C./min, filtered, sufficiently washed with ion-exchange water, and then dried. Hereby, toner particles (13) having a volume-average size of 7.5 μm are prepared.

Preparation of Toner and Developer

A toner (13) and a developer (13) are prepared as in Example 1, except that the toner particles (13) are used instead of the toner particles (1).

Example 14

Preparation of Toner Particles

Amorphous polyester resin dispersion: 500 parts
Crystalline polyester resin dispersion: 100 parts
Titanium white pigment dispersion: 100 parts
Release agent dispersion 4: 70 parts
Anionic surfactant "TaycaPower" produced by TAYCA CORPORATION: 8 parts The above materials are charged into a round-bottom flask made of stainless steel. To the resulting mixture, 0.1 N-nitric acid is added in order to adjust the pH of the mixture to be 2.5. Subsequently, 3 parts of an aqueous nitric acid solution containing polyaluminum chloride at a concentration of 10% is added to the mixture. After the mixture has been dispersed at 5° C. for 5 minutes with a homogenizer "ULTRA-TURRAX T50" produced by IKA, it is heated to 45° C. in an oil bath and then held for 30 minutes. Subsequently, 230 parts of the amorphous polyester resin dispersion is gradually further added to the mixture. After the mixture has been held for 1 hour, a 0.1 N-aqueous sodium hydroxide solution is added to the mixture in order to adjust the pH of the mixture to be 8.5. While being stirred, the mixture is then heated to 84° C., which is lower than the melting temperature of the release agent by 20° C., and subsequently held for 5 hours. The mixture is subsequently cooled to 20° C. at a rate of 20° C./min, filtered, sufficiently washed with ion-exchange water, and then dried. Hereby, toner particles (14) having a volume-average size of 7.5 m are prepared.

Preparation of Toner and Developer

A toner (14) and a developer (14) are prepared as in Example 1, except that the toner particles (14) are used instead of the toner particles (1).

Example 15

Preparation of Toner Particles

Amorphous polyester resin dispersion: 150 parts
Crystalline polyester resin dispersion: 100 parts
Titanium white pigment dispersion: 450 parts
Release agent dispersion 4: 70 parts Anionic surfactant "TaycaPower" produced by TAYCA CORPORATION: 8 parts The above materials are charged into a round-bottom flask made of stainless steel. To the resulting mixture, 0.1 N-nitric acid is added in order to adjust the pH of the mixture to be 2.5. Subsequently, 3 parts of an aqueous nitric acid solution containing polyaluminum chloride at a concentration of 10% is added to the mixture. After the mixture has been dispersed at 5° C. for 5 minutes with a homogenizer "ULTRA-TURRAX T50" produced by IKA, it is heated to 45° C. in an oil bath and then held for 30 minutes. Subsequently, 230 parts of the amorphous polyester resin dispersion is gradually further added to the mixture. After the mixture has been held for 1 hour, a 0.1 N-aqueous sodium hydroxide solution is added to the mixture in order to adjust the pH of the mixture to be 8.5. While being stirred, the mixture is then heated to 84° C., which is lower than the melting temperature of the release agent by 20° C., and subsequently held for 5 hours. The mixture is subsequently cooled to 20° C. at a rate of 20° C./min, filtered, sufficiently washed with ion-exchange water, and then dried. Hereby, toner particles (15) having a volume-average size of 7.5 m are prepared.

Preparation of Toner and Developer

A toner (15) and a developer (15) are prepared as in Example 1, except that the toner particles (15) are used instead of the toner particles (1).

Example 16

Preparation of Toner Particles

Amorphous polyester resin dispersion: 400 parts
Crystalline polyester resin dispersion: 100 parts
Titanium white pigment dispersion: 200 parts
Release agent dispersion 6: 70 parts
Anionic surfactant "TaycaPower" produced by TAYCA CORPORATION: 8 parts The above materials are charged into a round-bottom flask made of stainless steel. To the resulting mixture, 0.1 N-nitric acid is added in order to adjust the pH of the mixture to be 2.5. Subsequently, 3 parts of an aqueous nitric acid solution containing polyaluminum chloride at a concentration of 10% is added to the mixture. After the mixture has been dispersed at 5° C. for 5 minutes with a homogenizer "ULTRA-TURRAX T50" produced by IKA, it is heated to 45° C. in an oil bath and then held for 30 minutes. Subsequently, 230 parts of the amorphous polyester resin dispersion is gradually further added to the mixture. After the mixture has been held for 1 hour, a 0.1 N-aqueous sodium hydroxide solution is added to the mixture in order to adjust the pH of the mixture to be 8.5. While being stirred, the mixture is then heated to 67° C., which is lower than the melting temperature of the release agent by 20° C., and subsequently held for 10 hours. The mixture is subsequently cooled to 20° C. at a rate of 20° C./min, filtered, sufficiently washed with ion-exchange water, and then dried. Hereby, toner particles (16) having a volume-average size of 7.5 m are prepared.

Preparation of Toner and Developer

A toner (16) and a developer (16) are prepared as in Example 1, except that the toner particles (16) are used instead of the toner particles (1).

Example 17

Preparation of Toner Particles

Amorphous polyester resin dispersion: 400 parts
Crystalline polyester resin dispersion: 100 parts
Titanium white pigment dispersion: 200 parts
Release agent dispersion 7: 70 parts
Anionic surfactant "TaycaPower" produced by TAYCA CORPORATION: 8 parts The above materials are charged into a round-bottom flask made of stainless steel. To the resulting mixture, 0.1 N-nitric acid is added in order to adjust the pH of the mixture to be 2.5. Subsequently, 3 parts of an aqueous nitric acid solution containing polyaluminum chloride at a concentration of 10% is added to the mixture. After the mixture has been dispersed at 5° C. for 5 minutes with a homogenizer "ULTRA-TURRAX T50" produced by IKA, it is heated to 45° C. in an oil bath and then held for 30 minutes. Subsequently, 230 parts of the amorphous polyester resin dispersion is gradually further added to the mixture. After the mixture has been held for 1 hour, a 0.1 N-aqueous sodium hydroxide solution is added to the mixture in order to adjust the pH of the mixture to be 8.5. While being stirred, the mixture is then heated to 72° C., which is lower than the melting temperature of the release agent by 20° C., and subsequently held for 10 hours. The mixture is subsequently cooled to 20° C. at a rate of 20° C./min, filtered, sufficiently washed with ion-exchange water, and then dried. Hereby, toner particles (17) having a volume-average size of 7.5 μm are prepared.

Preparation of Toner and Developer

A toner (17) and a developer (17) are prepared as in Example 1, except that the toner particles (17) are used instead of the toner particles (1).

Example 18

Preparation of Toner Particles

Amorphous polyester resin dispersion: 400 parts
Crystalline polyester resin dispersion: 100 parts
Titanium white pigment dispersion: 200 parts
Release agent dispersion 8: 70 parts
Anionic surfactant "TaycaPower" produced by TAYCA CORPORATION: 8 parts The above materials are charged into a round-bottom flask made of stainless steel. To the resulting mixture, 0.1 N-nitric acid is added in order to adjust the pH of the mixture to be 2.5. Subsequently, 3 parts of an aqueous nitric acid solution containing polyaluminum chloride at a concentration of 10% is added to the mixture. After the mixture has been dispersed at 5° C. for 5 minutes with a homogenizer "ULTRA-TURRAX T50" produced by IKA, it is heated to 45° C. in an oil bath and then held for 30 minutes. Subsequently, 230 parts of the amorphous polyester resin dispersion is gradually further added to the mixture. After the mixture has been held for 1 hour, a 0.1 N-aqueous sodium hydroxide solution is added to the mixture in order to adjust the pH of the mixture to be 8.5. While being stirred, the mixture is then heated to 72° C., which is lower than the melting temperature of the release agent by 13° C., and subsequently held for 10 hours. The mixture is subsequently cooled to 20° C. at a rate of 20° C./min, filtered, sufficiently washed with ion-exchange water, and then dried. Hereby, toner particles (18) having a volume-average size of 7.5 m are prepared.

Preparation of Toner and Developer

A toner (18) and a developer (18) are prepared as in Example 1, except that the toner particles (18) are used instead of the toner particles (1).

Example 19

Preparation of Toner Particles

Amorphous polyester resin dispersion: 400 parts
Crystalline polyester resin dispersion: 100 parts
Metal pigment dispersion: 200 parts
Release agent dispersion 3: 70 parts
Anionic surfactant "TaycaPower" produced by TAYCA CORPORATION: 8 parts The above materials are charged into a round-bottom flask made of stainless steel. To the resulting mixture, 0.1 N-nitric acid is added in order to adjust the pH of the mixture to be 2.8. Subsequently, 3 parts of an aqueous nitric acid solution containing polyaluminum chloride at a concentration of 10% is added to the mixture. After the mixture has been dispersed at 5° C. for 5 minutes with a homogenizer "ULTRA-TURRAX T50" produced by IKA, it is heated to 45° C. in an oil bath and then held for 30 minutes. Subsequently, 230 parts of the amorphous polyester resin dispersion is gradually further added to the mixture. After the mixture has been held for 1 hour, a 0.1 N-aqueous sodium hydroxide solution is added to the mixture in order to adjust the pH of the mixture to be 8.5. While being stirred, the mixture is then heated to 80° C., which is lower than the melting temperature of the release agent by 10° C., and subsequently held for 10 hours. The mixture is subsequently cooled to 20° C. at a rate of 20° C./min, filtered, sufficiently washed with ion-exchange water, and then dried. Hereby, toner particles (19) having a volume-average size of 12.0 μm are prepared.

Preparation of Toner and Developer

A toner (19) and a developer (19) are prepared as in Example 1, except that the toner particles (19) are used instead of the toner particles (1).

Example 20

Preparation of Toner Particles

Amorphous polyester resin dispersion: 400 parts
Crystalline polyester resin dispersion: 100 parts
Metal pigment dispersion: 200 parts
Release agent dispersion 3: 70 parts
Anionic surfactant "TaycaPower" produced by TAYCA CORPORATION: 8 parts The above materials are charged into a round-bottom flask made of stainless steel. To the resulting mixture, 0.1 N-nitric acid is added in order to adjust the pH of the mixture to be 2.1. Subsequently, 3 parts of an aqueous nitric acid solution containing polyaluminum chloride at a concentration of 10% is added to the mixture. After the mixture has been dispersed at 5° C. for 5 minutes with a homogenizer "ULTRA-TURRAX T50" produced by IKA, it is heated to 45° C. in an oil bath and then held for 30 minutes. Subsequently, 230 parts of the amorphous polyester resin dispersion is gradually further added to the mixture. After the mixture has been held for 1 hour, a 0.1 N-aqueous sodium hydroxide solution is added to the mixture in order to adjust the pH of the mixture to be 8.5. While being stirred, the mixture is then heated to 65° C., which is lower than the melting temperature of the release agent by 25° C., and subsequently held for 10 hours. The mixture is subsequently cooled to 20° C. at a rate of 20° C./min, filtered, sufficiently washed with ion-exchange water, and then dried. Hereby, toner particles (20) having a volume-average size of 12.0 μm are prepared.

Preparation of Toner and Developer

A toner (20) and a developer (20) are prepared as in Example 1, except that the toner particles (20) are used instead of the toner particles (1).

Example 21

Preparation of Toner Particles

Amorphous styrene-acrylic resin dispersion: 200 parts
Crystalline styrene-acrylic resin dispersion: 50 parts
Titanium white pigment dispersion: 200 parts
Release agent dispersion 4: 70 parts
Anionic surfactant "TaycaPower" produced by TAYCA CORPORATION: 8 parts The above materials are charged into a round-bottom flask made of stainless steel. To the resulting mixture, 0.1 N-nitric acid is added in order to adjust the pH of the mixture to be 2.1. Subsequently, 3 parts of an aqueous nitric acid solution containing polyaluminum chloride at a concentration of 10% is added to the mixture. After the mixture has been dispersed at 5° C. for 5 minutes with a homogenizer "ULTRA-TURRAX T50" produced by IKA, it is heated to 45° C. in an oil bath and then held for 30 minutes. Subsequently, 115 parts of the amorphous styrene-acrylic resin dispersion is gradually further added to the mixture. After the mixture has been held for 1 hour, a 0.1 N-aqueous sodium hydroxide solution is added to the mixture in order to adjust the pH of the mixture to be 8.5. While being stirred, the mixture is then heated to 84° C., which is lower than the melting temperature of the release agent by 20° C., and subsequently held for 5 hours. The mixture is subsequently cooled to 20° C. at a rate of 20° C./min, filtered, sufficiently washed with ion-exchange water, and then dried. Hereby, toner particles (21) having a volume-average size of 7.5 μm are prepared.

Preparation of Toner and Developer

A toner (21) and a developer (21) are prepared as in Example 1, except that the toner particles (21) are used instead of the toner particles (1).

Comparative Example 1

Preparation of Toner Particles

Amorphous polyester resin dispersion: 400 parts
Crystalline polyester resin dispersion: 100 parts
Titanium white pigment dispersion: 200 parts
Release agent dispersion 4: 70 parts
Anionic surfactant "TaycaPower" produced by TAYCA CORPORATION: 8 parts The above materials are charged into a round-bottom flask made of stainless steel. To the resulting mixture, 0.1 N-nitric acid is added in order to adjust the pH of the mixture to be 3.2. Subsequently, 3 parts of an aqueous nitric acid solution containing polyaluminum chloride at a concentration of 10% is added to the mixture. After the mixture has been dispersed at 5° C. for 5 minutes with a homogenizer "ULTRA-TURRAX T50" produced by IKA, it is heated to 45° C. in an oil bath and then held for 30 minutes. Subsequently, 230 parts of the amorphous polyester resin dispersion is gradually further added to the mixture. After the mixture has been held for 1 hour, a 0.1 N-aqueous sodium hydroxide solution is added to the mixture in order to adjust the pH of the mixture to be 8.5. While being stirred, the mixture is then heated to 84° C., which is lower than the melting temperature of the release agent by 20° C., and subsequently held for 5 hours. The mixture is subsequently cooled to 20° C. at a rate of 20° C./min, filtered, sufficiently washed with ion-exchange water, and then dried. Hereby, toner particles (C1) having a volume-average size of 7.5 m are prepared.

Preparation of Toner and Developer

A toner (C1) and a developer (C1) are prepared as in Example 1, except that the toner particles (C1) are used instead of the toner particles (1).

Comparative Example 2

Preparation of Toner Particles

Amorphous polyester resin dispersion: 600 parts
Crystalline polyester resin dispersion: 100 parts
Release agent dispersion 4: 70 parts
Anionic surfactant "TaycaPower" produced by TAYCA CORPORATION: 8 parts The above materials are charged into a round-bottom flask made of stainless steel. To the resulting mixture, 0.1 N-nitric acid is added in order to adjust the pH of the mixture to be 2.5. Subsequently, 3 parts of an aqueous nitric acid solution containing polyaluminum chloride at a concentration of 10% is added to the mixture. After the mixture has been dispersed at 5° C. for 5 minutes with a homogenizer "ULTRA-TURRAX T50" produced by IKA, it is heated to 45° C. in an oil bath and then held for 30 minutes. Subsequently, 230 parts of the amorphous polyester resin dispersion is gradually further added to the mixture. After the mixture has been held for 1 hour, a 0.1 N-aqueous sodium hydroxide solution is added to the mixture in order to adjust the pH of the mixture to be 8.5. While being stirred, the mixture is then heated to 84° C., which is lower than the melting temperature of the release agent by 20° C., and subsequently held for 5 hours. The mixture is subsequently cooled to 20° C. at a rate of 20° C./min, filtered, sufficiently washed with ion-exchange water, and then dried. Hereby, toner particles (C2) having a volume-average size of 7.5 μm are prepared.

Preparation of Toner and Developer

A toner (C2) and a developer (C2) are prepared as in Example 1, except that the toner particles (C2) are used instead of the toner particles (1).

Evaluations

Stacking Resistance Test

Evaluation samples are prepared using a "DocuCentre Color 400" produced by Fuji Xerox Co., Ltd. Each of the developers prepared above is charged into a developing unit of the printer. Using A4-size JD sheets (basis weight: 157 gsm) produced by Fuji Xerox Co., Ltd. as recording media, an image is successively formed on 500 sheets at 28° C. and 50 RH % with a high area coverage (density: 100%, amount of toner deposited: 110 g/m$^2$). The printed sheets are ejected into the same output tray and left to stand for one hour while being stacked on top of one another.

An image defect that occurs in the image fixed onto the 51st printed sheet, in which an image defect is most likely to occur in consideration of the amount of latent heat and pressure, is evaluated. Table 2 summarizes the results.

In the image defect evaluation, the proportion of an area in which the image is detached from the sheet as a result of the melted images adhering to each other and the sheet is exposed.

Evaluation Standards

G1: The proportion of the image defect is less than 0.30%. It is difficult to visually determine the image defect.

G2: The proportion of the image defect is less than 0.50%. It is difficult to visually determine the image defect.

G3: The proportion of the image defect is 0.50% or more and less than 1.0%. The degree of the image defect is slight and acceptable.

G4: The proportion of the image defect caused by the adhesion of melted images is 1.0% or more, which is not acceptable.

Folding Resistance Test

Each of the developers prepared above is charged into a developing unit of a color copier "DocuCentre Color 400" produced by Fuji Xerox Co., Ltd. from which a fixing unit has been detached. After an adjustment has been made to change the amount of toner deposited to be 0.50 mg/cm$^2$, an unfixed image is formed on a recording medium that is an A4-size JD sheet (basis weight: 157 gsm) produced by Fuji Xerox Co., Ltd. The output image has a size of 50 mm×50 mm and an area coverage of 100%.

As a fixation evaluation machine, an "ApeosPortIV C3370" produced by Fuji Xerox Co., Ltd. from which a fixing unit has been detached and which is modified such that the fixing temperature can be changed is used. The processing speed is 175 mm/sec. The fixing temperature is 160° C.

The output solid image is pressed at a pressure of 40 g/cm$^2$ for 30 seconds while the sheet is folded such that the solid image is inside. Subsequently, the sheet is unfolded. After a broken portion of the image has been wiped with a soft cloth, the maximum width of the image defect is determined and used as a value for reflecting folding resistance. Table 2 summarizes the results. Although it is desirable that an image defect do not occur from the viewpoint of folding resistance, an image defect having a width of about 0.7 mm does not pose significant problems in service. Therefore, in Table 2, an evaluation grade of "A" is given to a case where the maximum width of the image defect is 0.4 mm or less; an evaluation grade of "B" is given to a case where the maximum width of the image defect is more than 0.4 mm and 0.7 mm or less; and an evaluation grade of "C" is given to a case where the maximum width of the image defect is more than 0.7 mm.

TABLE 1

| | Release agent | | Wax | Specific-heat substance | Wax Tm | Wax Tc |
|---|---|---|---|---|---|---|
| Example 1 | 1 | Paraffin wax 150 | Paraffin wax | Titanium white pigment | 66 | 61 |
| Example 2 | 2 | HNP 9 | Paraffin wax | Titanium white pigment | 75 | 67 |
| Example 3 | 3 | FNP0090 | Fischer-Tropsch wax | Titanium white pigment | 90 | 75 |

TABLE 1-continued

| | Release agent | | Wax | Specific-heat substance | Wax Tm | Wax Tc |
|---|---|---|---|---|---|---|
| Example 4 | 4 | FT105 | Fischer-Tropsch wax | Titanium white pigment | 104 | 89 |
| Example 5 | 5 | FT115 | Fischer-Tropsch wax | Titanium white pigment | 113 | 98 |
| Example 6 | 4 | FT105 | Fischer-Tropsch wax | Titanium white pigment | 104 | 88 |
| Example 7 | 4 | FT105 | Fischer-Tropsch wax | Titanium white pigment | 104 | 89 |
| Example 8 | 4 | FT105 | Fischer-Tropsch wax | Titanium white pigment | 104 | 80 |
| Example 9 | 4 | FT105 | Fischer-Tropsch wax | Titanium white pigment | 104 | 99 |
| Example 10 | 4 | FT105 | Fischer-Tropsch wax | Titanium white pigment | 104 | 94 |
| Example 11 | 4 | FT105 | Fischer-Tropsch wax | Metal pigment | 104 | 86 |
| Example 12 | 4 | FT105 | Fischer-Tropsch wax | Lead white pigment | 104 | 87 |
| Example 13 | 4 | FT105 | Fischer-Tropsch wax | Cobalt blue pigment | 104 | 87 |
| Example 14 | 4 | FT105 | Fischer-Tropsch wax | Titanium white pigment | 104 | 89 |
| Example 15 | 4 | FT105 | Fischer-Tropsch wax | Titanium white pigment | 104 | 89 |
| Example 16 | 6 | DIAMID Y | Amide wax | Titanium white pigment | 87 | 71 |
| Example 17 | 7 | Polyethylene PW600 | Polyethylene wax | Titanium white pigment | 92 | 77 |
| Example 18 | 8 | WEP-5 | Ester wax | Titanium white pigment | 85 | 71 |
| Example 19 | 3 | FNP0090 | Fischer-Tropsch wax | Metal pigment | 90 | 80 |
| Example 20 | 3 | FNP0090 | Fischer-Tropsch wax | Metal pigment | 90 | 67 |
| Example 21 | 4 | FT105 | Fischer-Tropsch wax | Titanium white pigment | 104 | 89 |
| Comparative example 1 | 4 | FT105 | Fischer-Tropsch wax | Titanium white pigment | 104 | 90 |
| Comparative example 2 | 4 | FT105 | Fischer-Tropsch wax | — | 104 | 99 |

TABLE 2

| | Tm − Tc | B/A ratio | Aggregation pH | Coalescence Temperature (° C.) | Difference in coalescence Temperature (Tm − temperature) | Proportion of specific-heat substance (%) | Stacking resistance | Folding resistance |
|---|---|---|---|---|---|---|---|---|
| Example 1 | 5 | 2.5 | 2.5 | 63 | 3 | 20 | G3 | B |
| Example 2 | 8 | 2.4 | 2.5 | 65 | 10 | 20 | G3 | B |
| Example 3 | 15 | 2.6 | 2.5 | 70 | 20 | 20 | G2 | A |
| Example 4 | 15 | 2.5 | 2.5 | 84 | 20 | 20 | G2 | A |
| Example 5 | 15 | 2.7 | 2.5 | 93 | 20 | 20 | G2 | A |
| Example 6 | 16 | 1.6 | 2.8 | 84 | 20 | 20 | G2 | A |
| Example 7 | 15 | 3.8 | 2.1 | 84 | 20 | 20 | G1 | A |
| Example 8 | 24 | 2.5 | 2.5 | 78 | 26 | 20 | G1 | A |
| Example 9 | 5 | 2.7 | 2.5 | 92 | 12 | 20 | G3 | B |
| Example 10 | 10 | 2.6 | 2.5 | 88 | 16 | 20 | G2 | A |
| Example 11 | 18 | 2.6 | 2.5 | 84 | 20 | 20 | G2 | A |
| Example 12 | 17 | 2.6 | 2.5 | 84 | 20 | 20 | G2 | A |
| Example 13 | 18 | 2.5 | 2.5 | 84 | 20 | 20 | G2 | A |
| Example 14 | 15 | 2.4 | 2.5 | 84 | 20 | 10 | G2 | A |
| Example 15 | 16 | 2.7 | 2.5 | 84 | 20 | 45 | G2 | B |
| Example 16 | 16 | 2.6 | 2.5 | 67 | 20 | 20 | G2 | A |
| Example 17 | 15 | 2.7 | 2.5 | 72 | 20 | 20 | G2 | A |
| Example 18 | 14 | 2.7 | 2.5 | 72 | 13 | 20 | G2 | A |
| Example 19 | 10 | 1.7 | 2.8 | 80 | 10 | 20 | G3 | B |
| Example 20 | 23 | 3.7 | 2.1 | 65 | 25 | 20 | G1 | A |
| Example 21 | 15 | 3.1 | 2.1 | 84 | 20 | 20 | G1 | A |
| Comparative example 1 | 14 | 1.4 | 3.2 | 84 | 20 | 20 | G4 | B |
| Comparative example 2 | 1.7 | 1.2 | 2.5 | 84 | 20 | 0 | G4 | C |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A toner for developing an electrostatic image, the toner comprising toner particles, each of the toner particles including: (i) a specific-heat substance including aluminum particles and having a specific heat of 0.1 kJ/(kg·K) or more and 1.0 kJ/(kg·K) or less, (ii) a binder resin, and (iii) a release agent, wherein a ratio B/A of a half-width B of an exothermic peak Tc resulting from the release agent, the exothermic peak Tc being determined in a first cooling step by differential scanning calorimetry, to a half-width A of an endothermic peak Tm resulting from the release agent, the endothermic peak Tm being determined in a first heating step prior to the first cooling step by differential scanning calorimetry, is 1.5 or more and 4 or less, and wherein the toner particles are prepared by adjusting an aggregation pH to a range of from 1.5 to 2.9.

2. The toner for developing an electrostatic image according to claim 1, wherein the ratio B/A is 2.5 or more and 3.8 or less.

3. The toner for developing an electrostatic image according to claim 1, wherein the ratio B/A is 3.1 or more and 3.8 or less.

4. The toner for developing an electrostatic image according to claim 1, wherein a difference between a temperature of the top of the endothermic peak Tm and a temperature of the top of the exothermic peak Tc is 8° C. or more and 25° C. or less.

5. The toner for developing an electrostatic image according to claim 1, wherein the difference between the temperature of the top of the endothermic peak Tm and the temperature of the top of the exothermic peak Tc is 8° C. or more and 17° C. or less.

6. The toner for developing an electrostatic image according to claim 1, wherein the binder resin includes a polyester resin.

7. The toner for developing an electrostatic image according to claim 1, wherein the binder resin includes a crystalline polyester resin.

8. The toner for developing an electrostatic image according to claim 7, wherein the ratio of the temperature of the top of the endothermic peak Tm to a melting temperature of the crystalline polyester resin is 0.90 or more and 1.82 or less.

9. The toner for developing an electrostatic image according to claim 7, wherein the ratio of the temperature of the top of the endothermic peak Tm to the melting temperature of the crystalline polyester resin is 1.22 or more and 1.41 or less.

10. The toner for developing an electrostatic image according to claim 7, wherein the melting temperature of the crystalline polyester resin is 60° C. or more and 85° C. or less.

11. The toner for developing an electrostatic image according to claim 1, wherein the temperature of the top of the endothermic peak Tm is 60° C. or more and 110° C. or less.

12. The toner for developing an electrostatic image according to claim 1, wherein the release agent includes a paraffin wax, a Fischer-Tropsch wax, a polyethylene wax, an ester wax, or an amide wax.

13. The toner for developing an electrostatic image according to claim 1, wherein the content of the specific-heat substance in each of the toner particles is 10% by mass or more and 45% by mass or less.

14. An electrostatic-image developer comprising the toner for developing an electrostatic image according to claim 1.

15. A toner cartridge detachably attachable to an image-forming apparatus, the toner cartridge comprising the toner for developing an electrostatic image according to claim 1.

16. The toner for developing an electrostatic image according to claim 1, wherein:

(i) the binder resin is at least one resin selected from the group consisting of a vinyl resin, a non-vinyl resin, and a graft polymer, wherein the non-vinyl resin is at least one resin selected from the group consisting of an epoxy resin, a polyester resin, a polyurethane resin, a polyamide resin, a cellulose resin, a polyether resin, and a modified rosin; and (ii) the release agent is at least one wax selected from the group consisting of a hydrocarbon wax, a natural wax, a synthetic wax, a mineral-petroleum-derived wax, an ester wax, and an amide wax.

17. The toner for developing an electrostatic image according to claim 1, wherein an amount of the release agent in the toner particles is 1% by mass or more and 20% by mass or less.

18. The toner for developing an electrostatic image according to claim 1, wherein an amount of the binder resin in the toner particles is 40% by mass or more and 95% by mass or less.

19. The toner for developing an electrostatic image according to claim 1, wherein the content of the specific-heat substance in each of the toner particles is 20% by mass or more and 35% by mass or less.

20. The toner for developing an electrostatic image according to claim 1, wherein the binder resin comprises an amorphous resin and a crystalline polyester resin, and a content of the crystalline polyester resin in the binder resin is in a range of 2% to 40% by mass.

* * * * *